US008061636B2

(12) United States Patent
Ito et al.

(10) Patent No.: US 8,061,636 B2
(45) Date of Patent: Nov. 22, 2011

(54) JET MILL

(75) Inventors: Kenzo Ito, Ota-ku (JP); Masahiro Yamamoto, Hamamatsu (JP); Etsuo Yamamoto, Hamamatsu (JP)

(73) Assignees: Sunrex Kogyo Co., Ltd., Tokyo (JP); NanoPlus Co., Ltd., Hamamatsu (JP); Ace Giken Co., Ltd., Hamamatsu (JP)

( * ) Notice: Subject to any disclaimer, the term of this patent is extended or adjusted under 35 U.S.C. 154(b) by 0 days.

(21) Appl. No.: 12/926,214

(22) Filed: Nov. 2, 2010

(65) Prior Publication Data

US 2011/0049278 A1 Mar. 3, 2011

Related U.S. Application Data

(62) Division of application No. 11/631,866, filed as application No. PCT/JP2005/007812 on Apr. 25, 2005, now Pat. No. 7,850,105.

(30) Foreign Application Priority Data

| | | |
|---|---|---|
| Jul. 9, 2004 | (JP) | 2004-203929 |
| Sep. 15, 2004 | (JP) | 2004-268504 |
| Dec. 6, 2004 | (JP) | 2004-353267 |
| Dec. 6, 2004 | (JP) | 2004-353275 |

(51) Int. Cl.
*B02C 19/06* (2006.01)

(52) U.S. Cl. ..... 241/39; 241/5

(58) Field of Classification Search ..... 241/5, 39, 241/40, 30

See application file for complete search history.

(56) References Cited

U.S. PATENT DOCUMENTS 1,799,476 A 4/1931 Newhouse (Continued)

FOREIGN PATENT DOCUMENTS

JP A 52-044450 4/1977

(Continued)

OTHER PUBLICATIONS

Microfilm of the specification and drawings annexed to the request of Japanese Utility Model Application No. 127617/1986 (Laid-open No. 35443/1988) (Kurimoto Ltd.) Mar. 7, 1988.

(Continued)

*Primary Examiner* — Faye Francis

(74) *Attorney, Agent, or Firm* — Oliff & Berridge, PLC

(57) ABSTRACT

A jet mill in which crushed material introduced into a crushing chamber is comminuted by gas being sprayed from a plurality of gas-jet nozzles, wherein high-efficiency pulverization is performed by optimizing various pulverization conditions according to the type of crushed material or other such properties. The direction in which gas is sprayed into the crushing chamber is variable adjustable; the spraying direction of each nozzle is displaced simultaneously by the electromotive actuator; swirl flow is produced in three dimensions, including the flow of a directional component that is perpendicular to the horizontal swirl flow; and a fine-powder discharge port of a first pulverization chamber and a fine powder introduction port of a second pulverization chamber are communicatingly connected by a ventilation duct.

6 Claims, 18 Drawing Sheets

U.S. PATENT DOCUMENTS

| | | | |
|---|---|---|---|
| 2,677,223 | A | 5/1954 | Schwarz |
| 2,930,535 | A | 3/1960 | Jones et al. |
| 3,491,953 | A | 1/1970 | Stephanoff |
| 5,628,464 | A | 5/1997 | Smith et al. |
| 6,196,482 | B1 | 3/2001 | Goto |
| 7,258,290 | B2 | 8/2007 | Taketomi et al. |
| 7,422,167 | B2 | 9/2008 | Olson |
| 7,438,245 | B2 | 10/2008 | Kawamoto et al. |
| 2005/0051649 | A1 | 3/2005 | Taketomi et al. |

FOREIGN PATENT DOCUMENTS

| | | |
|---|---|---|
| JP | A 59-026152 | 2/1984 |
| JP | A 63-035443 | 3/1988 |
| JP | A 2000-042441 | 2/2000 |
| JP | A 2000-107626 | 4/2000 |
| JP | B 33353312 | 10/2002 |

OTHER PUBLICATIONS

International Search Report dated Aug. 30, 2005, issued in PCT/JP2005/007812.

JET MILL

This is a Division of application Ser. No. 11/631,866 filed Aug. 8, 2007 (now U.S. Pat. No. 7,850,105 issued Dec. 14, 2010), which in turn is a National Stage of PCT/JP05/07812 filed Apr. 25, 2005. The disclosure of the prior applications is hereby incorporated by reference in its entirety.

BACKGROUND (1) Field of the Invention

The present invention relates to a jet mill in which crushed material introduced into a crushing chamber is comminuted by a swirl flow produced by a gas sprayed from a plurality of spray nozzles disposed along an inner perimeter wall of the crushing chamber.

(2) Description of Related Art

Jet mills pulverize and comminute crushed material introduced into a crushing chamber by a swirl flow from high-speed jets, and are useful in producing pesticides, toners, and other powders having poor heat resistance; ceramic powders; and a variety of other fine powders.

FIGS. 17 and 18 show schematic configurations of a conventional jet mill. FIG. 17 schematically shows a sectional configuration viewed from the side, and FIG. 18 schematically shows a cross section of the principal component thereof.

A jet mill 10' shown in the stated drawings is equipped with a plurality of gas-jet nozzles 20, 21 in a housing 11 that forms a crushing chamber 12. Each of the jet nozzles 20, 21 is fixed in place so that the spraying orifice belonging thereto faces a prescribed direction within the crushing chamber 12.

In the example shown in the stated drawings, one nozzle (20) among the plurality of gas-jet nozzles 20, 21 is formed as a solid-gas mixing ejector nozzle for feeding crushed material into the crushing chamber 12. The ejector nozzle (20) is used to introduce and spray crushed material fed from a hopper-shaped crushed material feed part 32 through a drive nozzle 31 along with a high-speed stream of gas.

High-pressure gas (air or another suitable gas) is fed into each of the gas-jet nozzles 20, 21 and the drive nozzle 31 via a gas feed tube 41 from a high-pressure actuating gas feed device 40. Crushed material introduced into the crushing chamber is drawn in, pulverized, and comminuted in the high-speed swirl flow generated by the gas sprayed from the plurality of gas-jet nozzles 20, 21 disposed along the inner perimeter wall of the crushing chamber 12. Comminuted powder is removed via a fine-powder discharge port 14 disposed above the central area of the crushing chamber 12.

An example of this type of jet mill is disclosed in Patent Document 1.

[Patent Document 1]

JP-B 3335312

PRIOR-ART PROBLEMS

According to the present inventors, conventional jet mills as described above have obvious problems such as those described below.

Specifically, the conventional jet mill 10' described above as shown in FIG. 18, for example, has the plurality of jet nozzles 20, 21 secured and mounted so that each spray orifice belonging thereto faces a prescribed direction within the crushing chamber 12 in order to generate a high-speed swirl flow within the crushing chamber 12. In this case, the jet nozzles 20, 21 were secured and mounted to spray gas in the expected optimal direction for generating the high-speed swirl flow.

According to the understanding of the present inventors, however, the optimal direction for spraying gas from each of the spraying nozzles 20, 21 is not necessarily fixed; rather, the direction has been demonstrated to vary across an extremely wide and diverse range depending on the type of crushed material and other factors.

For example, when pulverizing (comminuting) crushed material with a high degree of hardness, problems have arisen with the conventional art wherein the surface of the internal wall of the crushing chamber 12 has been scraped away by crushed material contacting the surface of the internal wall of the crushing chamber 12. Conventionally, the only method for avoiding this problem has been to slow down the swirl flow in the crushing chamber 12. However, slowing down the swirl flow causes problems insofar as the crushing efficiency dramatically decreases.

Nevertheless, according to knowledge obtained by the present inventors, generating a high-speed swirl flow so that crushed material substantially does not contact the surface of the inner wall of the crushing chamber 12 becomes possible by changing the direction in which each of the spraying nozzles 20, 21 sprays gas. The ability to obtain high crushing efficiency thereby without scraping away of the surface of the internal wall of the crushing chamber 12 has been demonstrated.

Conventionally, the sole method for increasing the pulverizing efficiency has been to increase the gas spray rate. The pressure of the actuating gas must be increased in order to increase the gas spray rate. Large-scale compressor equipment that consumes large amounts of electricity is needed in order to obtain this high-pressure actuating gas.

However, according to knowledge obtained by the present inventors, the pulverizing efficiency is not necessarily based only on the gas spray rate, and it has been demonstrated that the spray direction is an extremely large parameter element. Therefore, if the spraying direction can be appropriately established, high-efficiency pulverization can be performed even using small-scale compressor equipment with low power consumption.

However, the spray direction regarded to be optimal is not fixed but varies over a wide or narrow range depending on conditions such as the type and amount of crushed material. The ability to manage these varying conditions quickly and appropriately is a prerequisite for performing high-efficiency pulverization, but conventional jet mills as described above have not necessarily been equipped to meet this requirement.

SUMMARY

A first object of the present invention is to provide a jet mill enabled to perform high-efficiency pulverization by optimizing various pulverization conditions according to the type of crushed material or other such properties.

A second object of the present invention is to provide a jet mill enabled to perform high-efficiency pulverization by increasing the probability of collision between crushed material particles driven by a swirl flow.

A third object of the present invention is to provide a jet mill suited to achieve good pulverization performance and good particle size distribution of the powder obtained via pulverization.

A fourth object of the present invention is to provide a jet mill capable of alleviating or removing the necessity and procedural burden of post-treatment grading by performing the grading at the same time as pulverization.

A fifth object of the present invention is to provide a jet mill capable of alleviating the burden created by peripheral equipment such as compressors while achieving high pulverization performance.

A sixth object of the present invention is to provide a jet mill capable of performing high-efficiency pulverization by optimizing various pulverization conditions according to the type of crushed material or other such properties. [*1]

Objects and characteristics of the present invention other than those described above shall become clear in the description and accompanying drawings of the present specification.

In order to accomplish the aforesaid objects, the following aspects are disclosed in relation to the present invention.

Specifically, a first major aspect of the present invention is a jet mill in which crushed material introduced into a crushing chamber is comminuted by gas being sprayed from a plurality of gas-jet nozzles disposed along an internal perimeter wall of the crushing chamber, wherein the direction in which the gas is sprayed into the crushing chamber is variably adjustable.

A second major aspect of the present invention is the first aspect in which the gas-jet nozzles are inserted in a through-hole formed in the housing of the crushing chamber in a state allowing unrestricted movement in a radial direction, and are pivotally supported in the through-hole by a movable bearing that allows the gas-jet nozzles to be directionally adjustable.

A third major aspect of the present invention is the second aspect in which the movable bearing is a spherical bearing, the gas-jet nozzles are pivotally supported in a directionally adjustable manner, and a seal part for plugging the through-hole is formed.

A fourth major aspect of the present invention is the third aspect in which a concave groove is formed in an annular shape along a sliding surface of the spherical bearing, and pressurized gas is introduced into the annular groove.

A fifth major aspect of the present invention is any of the first through fourth aspects in which variable holding means is provided for holding the gas-jet nozzles in a positionally adjustable manner on a component disposed outside of the housing of the crushing chamber.

A sixth major aspect of the present invention is any of the above-mentioned first through fifth aspects in which at least one of the plurality of gas-jet nozzles forms a solid-gas mixing ejector nozzle for feeding crushed material into the crushing chamber.

A seventh major aspect of the present invention is a jet mill in which crushed material introduced into a horizontal disk-shaped crushing chamber is comminuted by a swirl flow produced by gas sprayed from a plurality of spraying nozzles disposed in a ring along an internal perimeter wall of the crushing chamber, the jet mill comprising a movable bearing for pivotally supporting the plurality of spraying nozzles so as to allow movement of the direction in which gas is sprayed from each; an annular movable member that is disposed above or below a row of the nozzles, and is movably supported to swivel in a direction orthogonal to the axial direction of the nozzles; an electromotive actuator for swivelably driving the annular movable member; and a link arm for linking a distal side of each spraying nozzle to a corresponding circumferential position on the annular movable member in an angularly displaceable manner, wherein the spraying direction of each nozzle is displaced simultaneously by the electromotive actuator.

An eighth major aspect of the present invention is the seventh aspect comprising any of the first through sixth aspects.

A ninth major aspect of the present invention is the seventh or eighth aspect in which the electromotive actuator is linked to one of the link arms linked to the annular movable member, and swivelably drives the annular movable member via the linked link arm.

A tenth major aspect of the present invention is any of the seventh through ninth aspects in which an electric motor provided with a rotational deceleration mechanism is used as a drive source unit for the electromotive actuator, and control means is provided for stopping the annular movable member in an arbitrary positional displacement.

An eleventh major aspect of the present invention is any of the seventh through ninth aspects in which an oscillation drive unit for driving high-rate oscillation of the annular movable member is used as the electromotive actuator.

A twelfth major aspect of the present invention is a jet mill in which crushed material introduced into a horizontal disk-shaped crushing chamber is comminuted by a swirl flow produced by gas sprayed from a plurality of spraying nozzles disposed in a ring along an internal perimeter wall of the crushing chamber, the jet mill comprising an oblique spraying nozzle for spraying gas in an oblique direction relative to the horizontal plane, thereby causing a swirl flow to be produced in three dimensions, including the flow of a directional component that is perpendicular to the horizontal swirl flow.

A thirteenth major aspect of the present invention is the twelfth aspect comprising any of the first through eleventh aspects.

A fourteenth major aspect of the present invention is the twelfth or thirteenth aspects comprising a horizontal spraying nozzle disposed to generate a swirl flow in a horizontal direction within the crushing chamber, and an oblique spraying nozzle disposed to produce a flow having a directional component that is perpendicular to the above-mentioned swirl flow.

A fifteenth major aspect of the present invention is any of the twelfth through fourteenth aspects in which nozzle pairs obtained by arranging horizontal spraying nozzles and oblique spraying nozzles in perpendicular directions are disposed in a ring along an inner perimeter wall of the crushing chamber.

A sixteenth major aspect of the present invention is the twelfth through fifteenth aspects in which a distal surface of the spraying nozzles is formed in a spherical shape.

A seventeenth major aspect of the present invention is a jet mill in which crushed material introduced into a crushing chamber is comminuted by gas being sprayed from a plurality of gas-jet nozzles disposed along an internal perimeter wall of the crushing chamber, wherein the jet mill comprises first and second crushing chambers, the two pulverization chambers comminute the material by the swirl flow and have a fine-powder discharge port in an upper central area of the crushing chambers, the first pulverization chamber [*2] is provided with a solid-gas mixing ejector nozzle for feeding crushed material from the exterior, the second pulverization chamber has a fine powder introduction port formed in a lower central area of the crushing chamber, and the fine-powder discharge port of the first pulverization chamber and the fine powder introduction port of the second pulverization chamber are communicatingly connected by a ventilation duct.

An eighteenth major aspect of the present invention is the seventeenth aspect comprising any of the first through sixteenth aspects.

A nineteenth major aspect of the present invention is the seventeenth or eighteenth aspect in which the second pulverization chamber is disposed concentrically above the first pulverization chamber, and the first pulverization chamber and the second pulverization chamber are linked in a vertical direction via the ventilation duct.

A twentieth major aspect of the present invention is any of the seventeenth through nineteenth aspects comprising a straightening member for inhibiting reverse flow of fine powder between the fine-powder discharge port of the first pulverization chamber and the fine powder introduction port of the second pulverization chamber.

A twenty-first major aspect of the present invention is the twentieth aspect in which the straightening member is a flattened-cone member and is disposed so as to selectively plug a central area of the fine powder introduction port.

A twenty-second major aspect of the present invention is the twenty-first aspect in which the direction in which gas is sprayed into the crushing chambers can be variably adjusted in at least one of the crushing chambers.

DETAILED DESCRIPTION OF EMBODIMENTS

First Aspect

Figure 1:
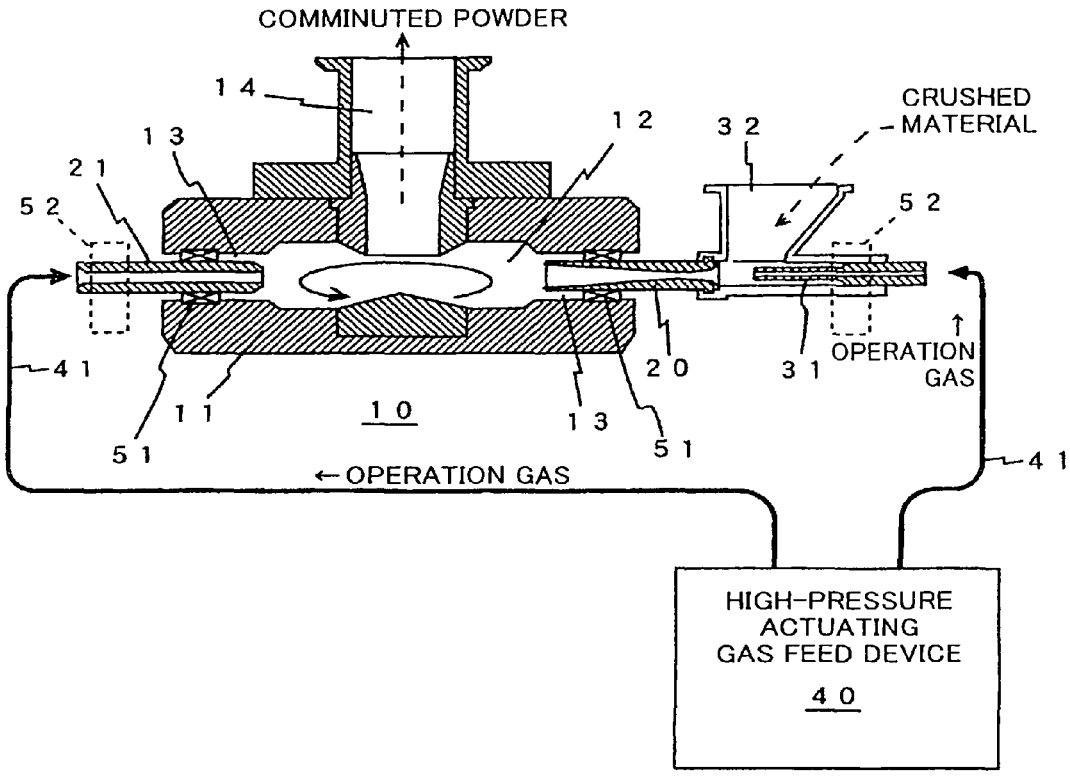
FIG. 1 is a lateral sectional view that schematically shows the principal component of a jet mill according to a first aspect of the present invention.

In a first aspect, there is provided a jet mill enabled to perform high-efficiency pulverization by optimizing a variety of pulverization conditions according to the type of crushed material or other such properties. The first aspect will be described below based on the example shown in the drawings.

Figure 2:
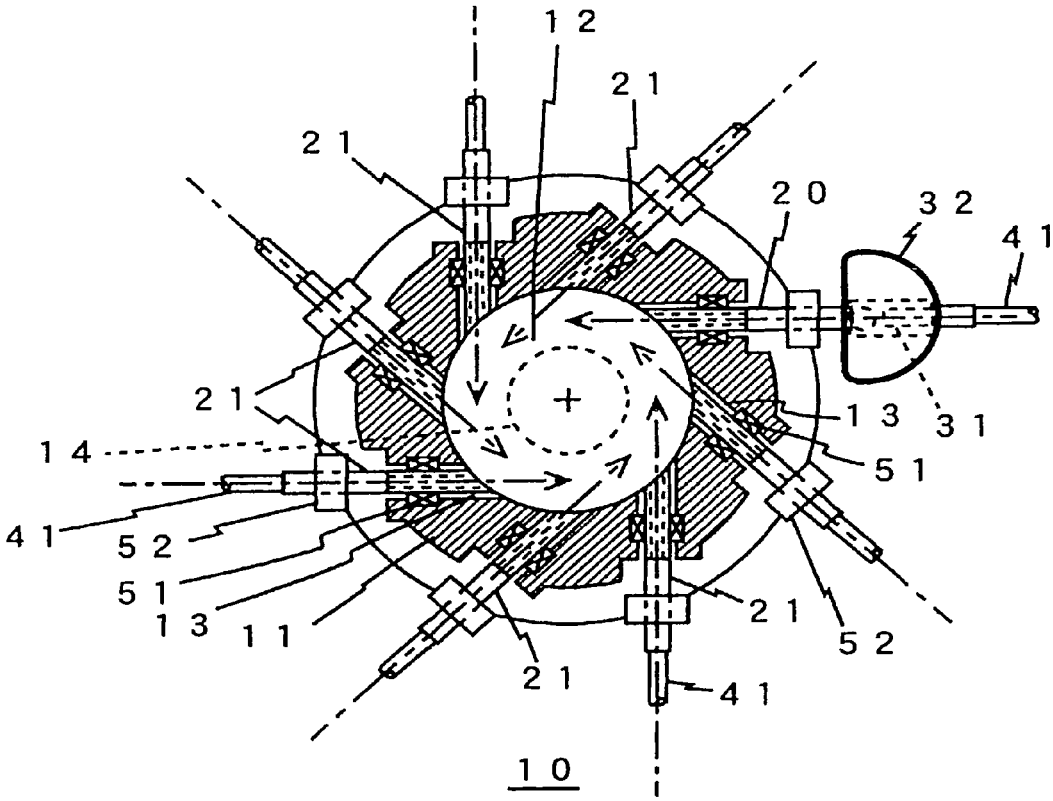
FIG. 2 is a cross-sectional view that schematically shows the principal component of a jet mill according to the first aspect.

FIGS. 1 and 2 show a schematic configuration of a jet mill constituting the first aspect of the present invention. For this aspect, FIG. 1 schematically shows a sectional configuration as viewed from the side, and FIG. 2 schematically shows a cross-sectional view of the principal component thereof.

A jet mill 10 shown in the stated drawings is provided with a plurality of gas-jet nozzles 20, 21 in a housing 11 that describes a crushing chamber 12. Each of the jet nozzles 20, 21 is fixed in place so that the spray orifice thereof faces into the crushing chamber 12.

In the example shown in the stated drawings, one nozzle (20) among the plurality of gas-jet nozzles 20, 21 is formed as a solid-gas mixing ejector nozzle for feeding crushed material into the crushing chamber 12. The ejector nozzle (20) is used to introduce and spray crushed material fed from a hopper-shaped crushed material feed part 32 through a drive nozzle 31 along with a high-speed stream of gas.

High-pressure gas (air or another suitable gas) is fed into each of the gas-jet nozzles 20, 21 and the drive nozzle 31 via a gas feed tube 41 from a high-pressure actuating gas feed device 40. Crushed material introduced into the crushing chamber is drawn in, pulverized, and comminuted in the high-speed swirl flow generated by the gas sprayed from the plurality of gas-jet nozzles 20, 21 disposed along the inner perimeter wall of the crushing chamber 12. Comminuted powder is removed via a fine-powder discharge port 14 disposed above the central area of the crushing chamber 12.

Each of the gas-jet nozzles 20, 21 is inserted in a through-hole 13 formed in the housing 11 of the crushing chamber 12 in a state allowing unrestricted movement in a radial direction. A portion of the nozzle is shown in detail in FIG. 3. Movable bearings 51 are provided so as to pivotally support the gas-jet nozzles 20, 21 in the through-hole 13 in a directionally adjustable manner. The resulting arrangement allows the direction in which gas is sprayed into the crushing chamber 12 to be variably adjustable.

Figure 3:
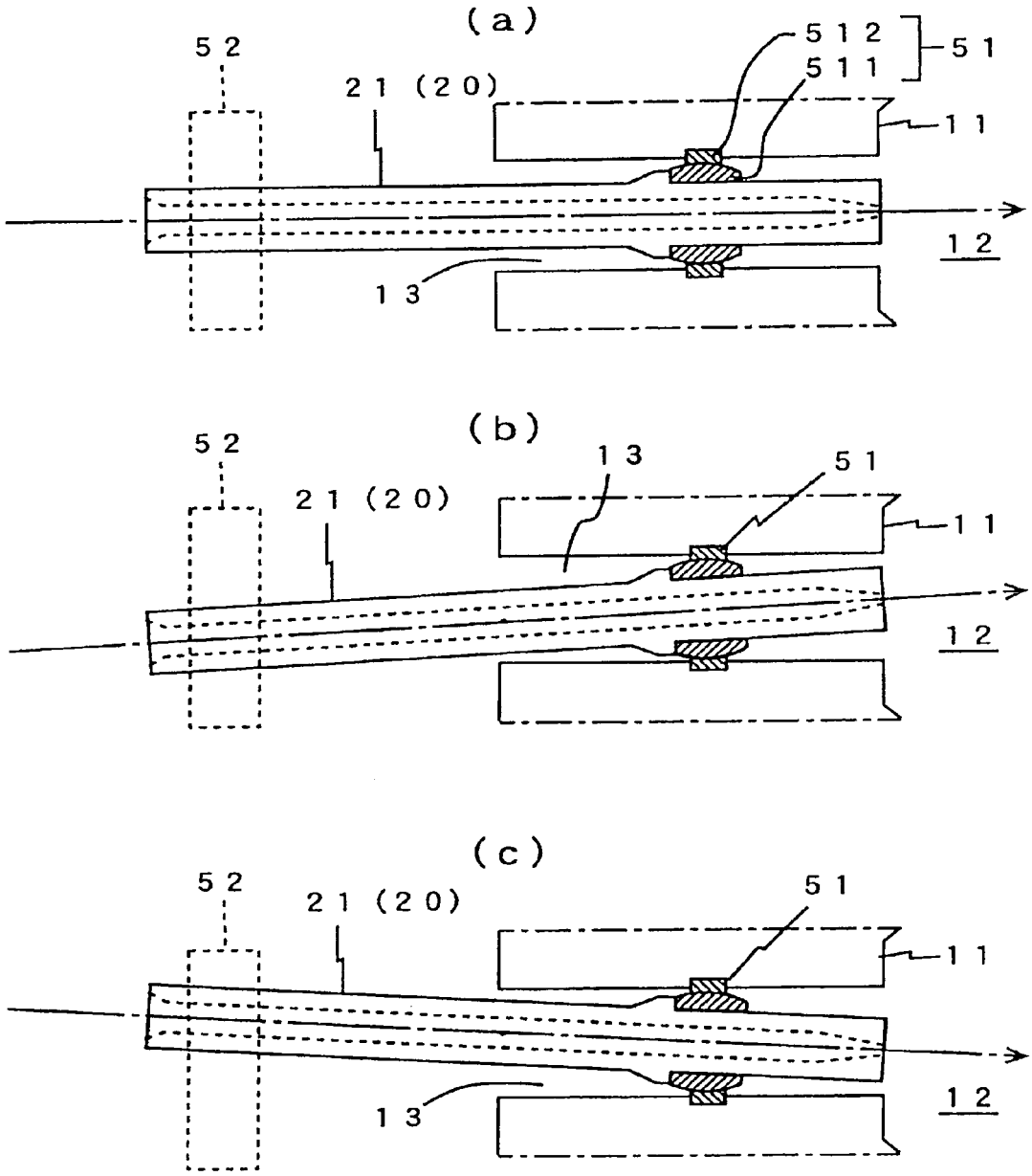
FIG. 3 is a partial sectional view showing a state in which a gas-jet nozzle according to the first aspect is installed.

Spherical bearings are used as the movable bearings 51. As shown in FIG. 3, the spherical bearings (movable bearings) 51 are configured using an annular mobile slider 511 with a spherical outer circumferential surface, and an annular fixed slider 512 having a spherical inner circumferential surface that is fit onto the outer circumferential surface of the mobile slider 511. The mobile slider 511 is mounted on the outer circumference of the spraying nozzles 20, 21. The fixed slider 512 is mounted on the inner side of the through-hole 13.

The gas-jet nozzles 20, 21 are designed to be able to face each of the directions shown in FIGS. 3A, 3B, and 3C in the through-hole 13 via the movable bearings 51. In other words, the gas-jet nozzles 20, 21 are pivotally supported in a directionally adjustable manner.

The movable bearings 51, which comprise spherical bearings, also form a seal part that plugs the through-hole 13. Reverse flow or leakage of gas from the crushing chamber 12 is accordingly inhibited.

Figure 4:
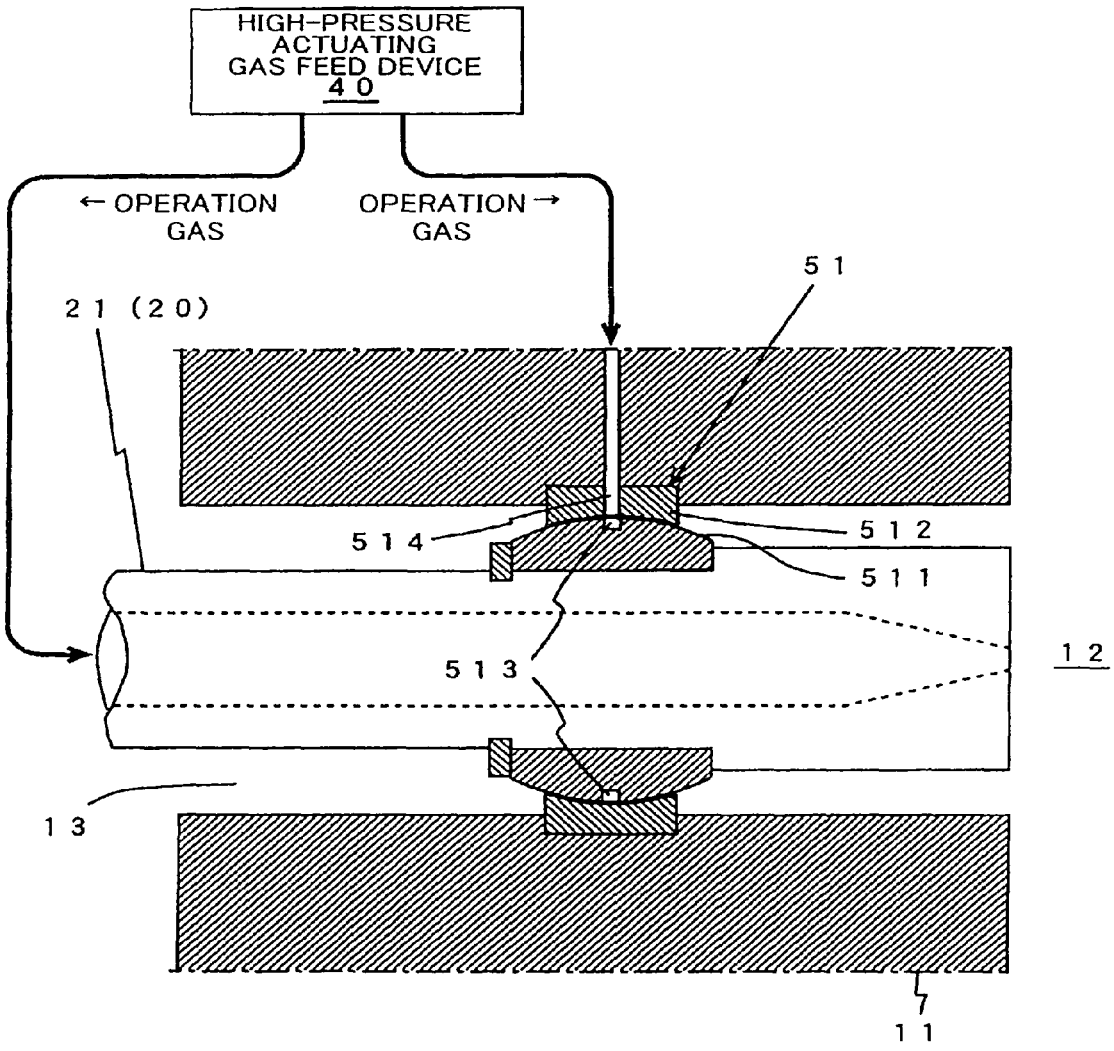
FIG. 4 is a partial sectional view showing the movable bearing part of a gas-jet nozzle according to the first aspect.

A concave groove 513 is formed in the movable bearings 51 along the center of the spherical part of the mobile slider 511 that faces the outer circumference, and a feeder 514 for introducing compressed gas into the annular channel 513 is formed on the side of the fixed slider 512, as shown in an enlargement of the principal component thereof in FIG. 4. In this way, a self-cleaning effect that prevents infiltration or adhesion of crushed material into or onto the movable bearing 51 and the immediate vicinity thereof is obtained.

As shown in FIG. 3, variable holding means 52, which holds the gas-jet nozzles 20, 21 in a positionally adjustable manner, is provided to a component disposed outside of the housing 11 of the crushing chamber 12.

Figure 5:
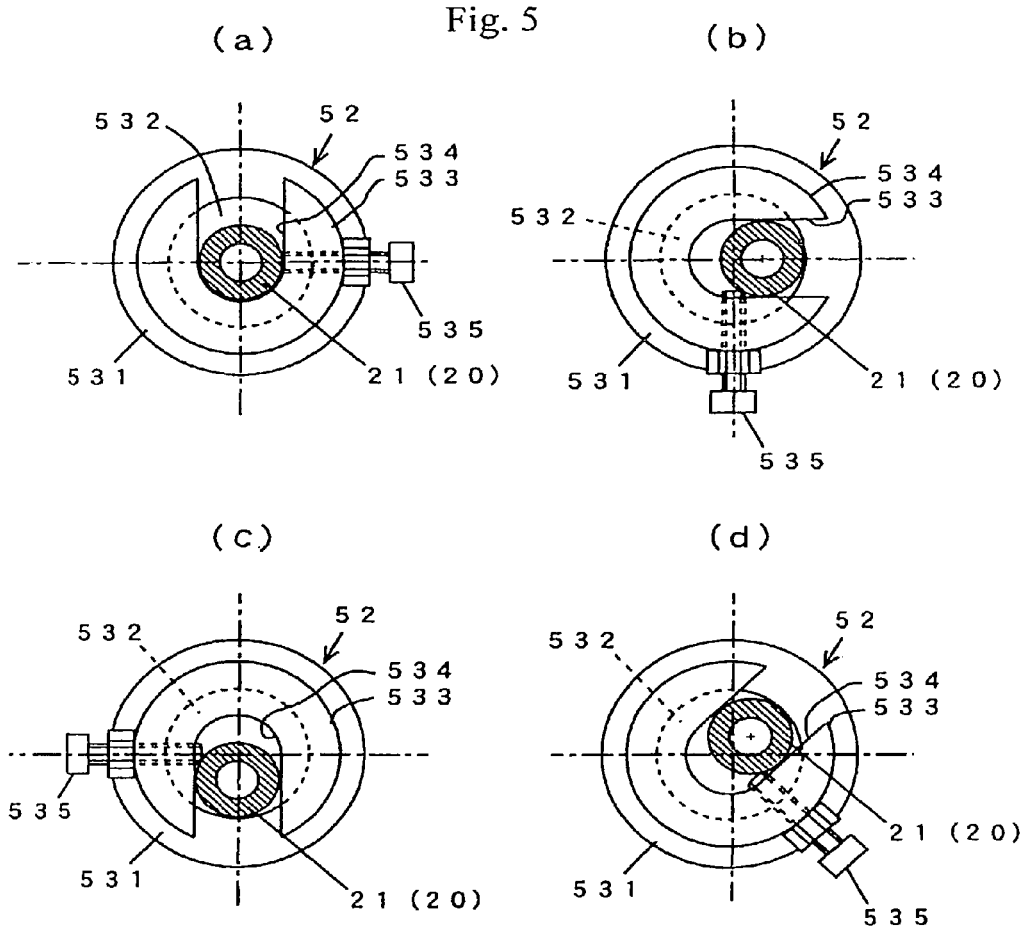
FIG. 5 is a front view showing a main component of variable holding means for holding the gas-jet nozzles in a positionally adjustable manner according to the first aspect.

FIG. 5 shows examples of specific configurations of the variable holding means 52. The variable holding means 52 shown in the drawing is configured using a fixed member 531 having a centrally disposed through-hole 532, a rotatable movable member 533 having a U-shaped notch part 534, and a fixing screw (set screw) 535.

In FIG. 5, the gas-jet nozzles 20, 21 are inserted in the notch 534 of the movable member 533 in a state in which the nozzles have latitude of movement via the through-hole 532 of the boss 531. In this state, the gas-jet nozzles 20, 21 are able to change position unrestrictedly within the through-hole 532, and can be fixed in any position by being tightened via the fixing screw 535, as shown in FIGS. 5A through 5D.

Accordingly, the gas-jet nozzles 20, 21 are able to be variably adjusted in any direction using the movable bearing 51 as a fulcrum, and can be fixed in any adjustable position.

Therefore, the jet mill described above can carry out high-efficiency pulverization by optimizing various pulverization conditions according to the type of crushed material or other such properties through a configuration that allows the direction in which gas is sprayed into the crushing chamber to be variably adjusted.

A variety of modes for the first aspect other than the format described above are possible. For example, the direction of the gas-jet nozzles 20, 21 may be variably adjusted by an electric motor having a suitable deceleration mechanism.

Alternatively, the gas-jet nozzles may be variably adjusted during the pulverization operation. The gas-jet nozzles 20, 21 may be variably adjusted by motors disposed on each nozzle; however, distributing rotational motion received from a common motor via suitable linking mechanisms to the variable adjustment mechanisms of the gas-jet nozzles 20, 21 is also acceptable.

The first aspect described above is also effective when applied to a cascade treatment system, which is a pulverization treatment wherein crushed material that has undergone a pulverization treatment in a first jet mill is introduced into the crushing chamber of a second jet mill.

In such instances, the first jet mill crushes and comminutes crushed material introduced into the crushing chamber 12 from the solid-gas mixing ejector nozzle (20) by a swirl flow within the crushing chamber. The fine-powder discharge port 14 of the first jet mill is connected to the crushing chamber of the second jet mill. By introducing crushed material subjected to a crushing procedure in the first jet mill into the crushing chamber of the second jet mill and performing another crushing procedure, the treatment for pulverizing crushed material can be carried out reliably and with high efficiency.

Accordingly, contamination with coarse particles referred to as "spill" or "spillover" in the crushed material subjected to the crushing treatment can be prevented, resulting in comminuted material (fine powder) that has particle sizes below a set level or within a set range without troublesome separation procedures having to be performed using classifiers and the like.

In the cascade treatment above, optimizing for the dual functionalities of crushing and grading is possible by variably adjusting the spraying direction of the gas-jet nozzles.

According to the first aspect described above, a jet mill in which crushed material introduced into a crushing chamber is comminuted by gas being sprayed from a plurality of gas-jet nozzles disposed along the internal perimeter wall of the crushing chamber enables high-efficiency pulverization to be performed by optimizing various pulverization conditions according to the type of crushed material or other such properties.

Second Aspect

A second aspect resolves the technical problems described below in addition to the solutions of the first aspect.

Specifically, in this type of jet mill, a plurality (approximately six is standard) of nozzles is provided to one crushing chamber. The conditions for optimizing crushing efficiency, however, vary depending on the type of crushed material, the size of the crushing chamber, the magnitude of pulverization, and the like. Thus, optimization settings for gas-spraying direction are necessary for each of these conditions. Significant labor is involved in variably adjusting the individual spraying directions of the plurality of nozzles 20, 21 in order to determine the optimal conditions.

It was learned that extensive trials must be performed before the optimal conditions are set up, that longer trials increase the processing time, electrical and other operational costs, waste of crushed material, and the like, and that, on the whole, efficiency-increasing optimization operations that include the trials produce inefficient results. At a minimum, the fact that the expected increase in efficiency will not be obtained has been demonstrated.

For this reason, the present inventors investigated attaching electric motor actuators to each of the nozzles 20, 21 and variably manipulating the spraying direction of each of the nozzles 20, 21 in a uniform manner with the aid of these electromotive actuators. However, such circumstances require a large number of electromotive actuators to be used, and problems are presented in regard to the difficulty of securing the space necessary to position these large numbers of electromotive actuators in the vicinity of the nozzles 20, 21. Ultimately, the fact that the system was not truly practical has been demonstrated.

The present inventors then discovered that, if the spraying direction of the nozzles 20, 21 is changed and the direction of swirl flow is pulsed while gas is sprayed from the nozzles 20, 21, the probability of collision and contact between crushed material particles will increase and improved crushing efficiency can be obtained. However, each of the nozzles 20, 21 must be swivelably driven at the same time.

The second aspect was devised in view of the technical problems described above, with an object thereof being to provide a jet mill enabled to perform high-efficiency pulverization by optimizing various pulverization conditions according to the type of crushed material or other such properties.

The second aspect, which accomplishes the above object, will be disclosed based on the example in the drawings.

Figure 6:
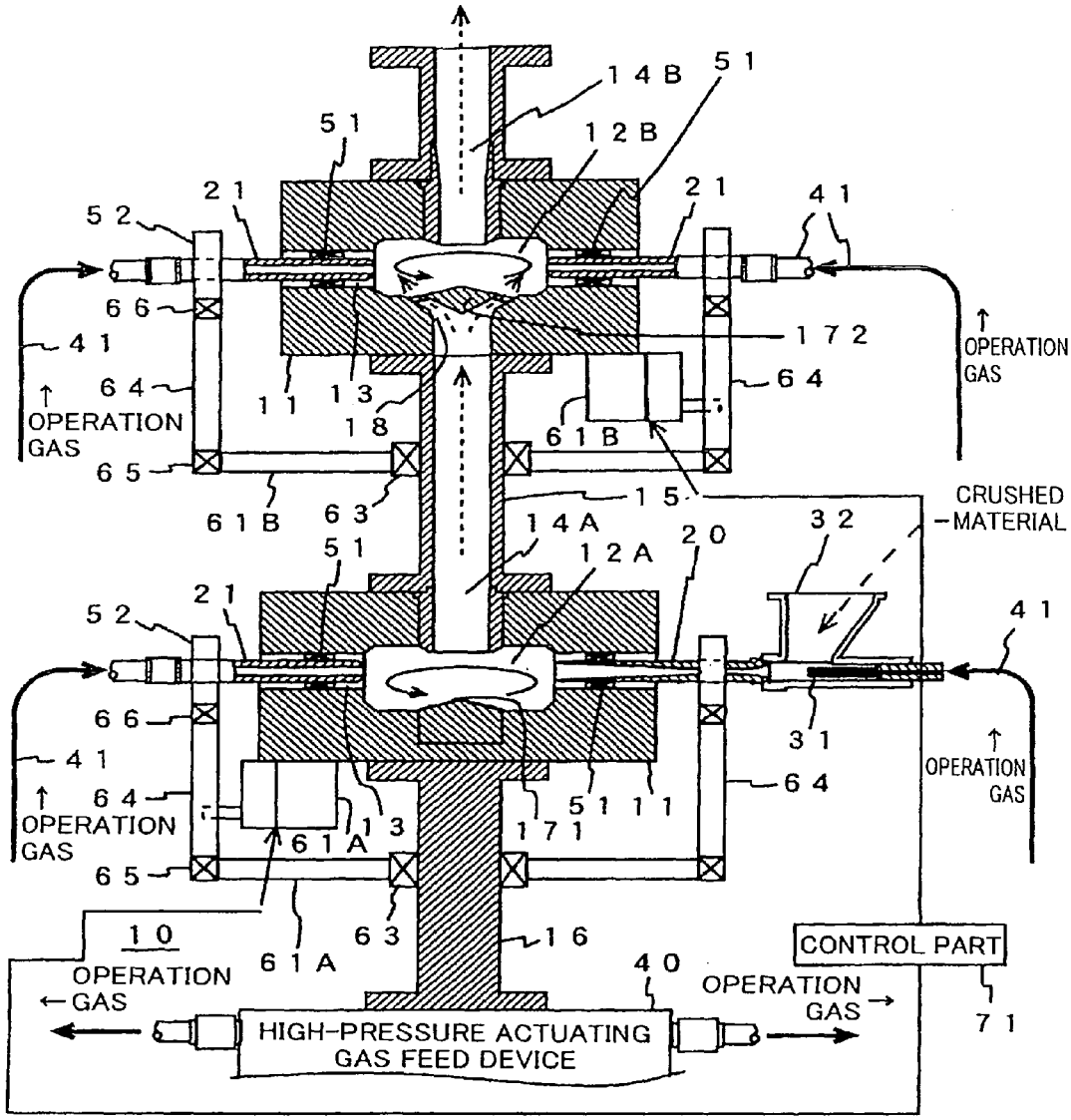
FIG. 6 is a partial schematic lateral sectional view showing an embodiment of the principal component of a jet mill according to a second aspect of the present invention.

FIG. 6 shows a schematic configuration of a jet mill in a lateral sectional view according to the second aspect. A jet mill 10 shown in the drawing comminutes crushed material introduced into crushing chambers 12A, 12B by a swirl flow generated by gas sprayed from a plurality of spraying nozzles 20, 21 disposed along the internal perimeter wall of the crushing chambers 12A, 12B. The jet mill has first and second crushing chambers 12A, 12B.

The first and second crushing chambers 12A, 12B each comminute the crushed material by a gas spray and have fine-powder discharge ports 14A, 14B in the upper central area of the crushing chambers 12A, 12B.

The second crushing chamber 12B is disposed concentrically above the first crushing chamber 12A. Both crushing chambers 12A and 12B are linked in the vertical direction via a tubular-pipe ventilation duct 15. The housing 11 of the first pulverization chamber 12A is disposed above a vertical support 16, and the housing 11 of the second pulverization chamber 12B is disposed above the ventilation duct 15.

A solid-gas mixing ejector nozzle 20 used to feed crushed material from the outside is disposed in the first crushing chamber 12A. A fine powder introduction port 18 is formed in the lower central area of the second crushing chamber 12B. The fine-powder discharge port 14A of the first crushing chamber 12A and the fine powder introduction port 18 of the second crushing chamber 12B are connected together by the ventilation duct 15.

A straightening member 172 that inhibits reverse flow of fine powder is disposed between the fine-powder discharge port 14A of the first crushing chamber 12A and the fine powder introduction port 18 of the second crushing chamber 12B. The straightening member 172 is a flattened-cone member and is disposed so as to selectively plug the central area of the fine powder introduction port 18. The straightening member 172 is fixed in a prescribed position by a stay part 173. An annular ventilation pathway is formed between the straightening member 172 and the fine powder introduction port 18.

The spraying nozzles 20, 21 are each inserted in a through-hole 13 formed in the housing 11 of the crushing chambers 12 (12A, 12B), and are able to move unrestrictedly in a radial direction. In addition, each of the spraying nozzles 20, 21 is pivotally supported by a movable bearing 51 within the through-holes 13. The movable bearing 51 movably supports the spraying nozzles 20, 21 so they can swivel in the direction orthogonal to the associated axial direction.

An annular movable member 61A is disposed below the nozzle ring (20, 21) of the first crushing chamber 12A, and is movably supported so as to be able to swivel in a direction orthogonal to the axial direction of the nozzles 20, 21. The annular movable member 61A is disc-shaped with a centrally disposed through-hole, and is pivotally and swivelably supported by an annular swivel bearing 63 on the support 16.

The proximal side of each of the nozzles 20, 21 is linked to a corresponding position on the circumference of the annular movable member 61A via respective link arms 64. The link arms 64 are each formed to the same length. The linking provided by the link arms 64 is accomplished by directionally displaceable linkage parts (free joints) 65, 66. In this way, the nozzles 21, 20 [*3] are linked to the other nozzles by common connection to the annular movable member 61A via the link arm 64 of each nozzle.

The annular movable member 61A is swivelably driven in a circular loop in the direction orthogonal to the axial direction of the nozzles 20, 21 via an electromotive actuator 62A. In this case, an electric motor provided with a rotational deceleration mechanism and a mechanism that converts to rotational or another such mode is used as the drive source unit for the electromotive actuator 62A. The drive operation of the electromotive actuator 62 is controlled by a control part 71. The control part 71 is provided with positional control functionality for stopping the annular movable member 61 in an arbitrary positional displacement. To exert this control, the electromotive actuator 62 is provided with positional detection functionality.

The electromotive actuator 62A is linked to one of the link arms 64 in this embodiment, and swivelably drives the annular movable member 61A via this linked link arm 64. The annular movable member 61A is configured so as to transmit the same stroke movement to each of the link arms 64. In this way, each of the nozzles 20, 21 is swivelably driven in a circular loop at the same time and with the same displacement stroke via the electromotive actuator 62A.

The swiveling drive of the electromotive actuator 62 may have operational modes other than a circular loop, such as linear reciprocating motion, if necessary.

Figure 7:
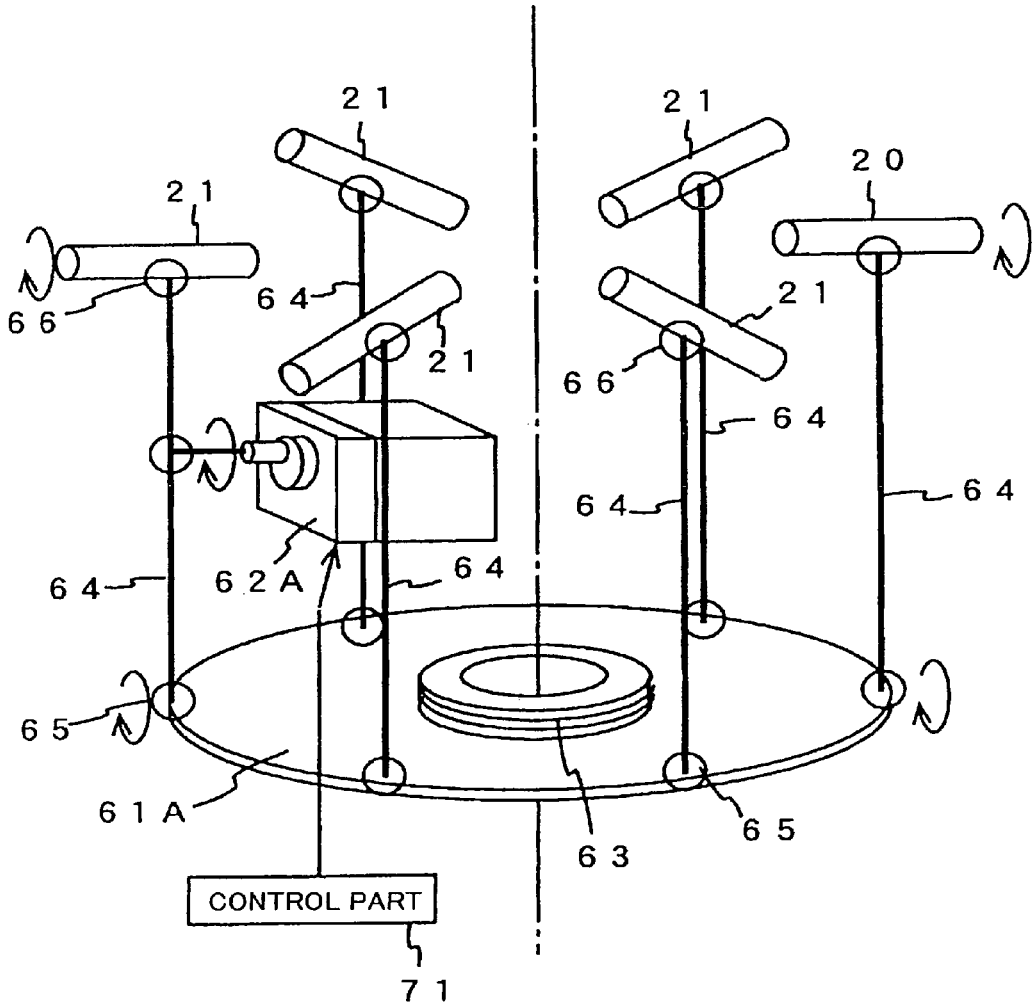
FIG. 7 schematically shows a mechanical component for variably driving the spraying direction of the nozzles according to the second aspect.

FIG. 7 schematically shows a mechanical component for variably driving the spraying direction of the nozzles 20, 21. As shown in the drawing, the direction of each of the nozzles 20, 21 is variably driven simultaneously in a mutually linked state by the annular movable member 61A, the electromotive actuator 62A, and the link arms 64.

Below the nozzle ring (21) of the second crushing chamber 12B, and in a manner similar to that described above, are provided an annular movable member 61B that is movably supported to be able to swivel in the direction orthogonal to the axial direction of the nozzles 21, an electromotive actuator 62B that swivelably drives the annular movable member 61B, and link arms 64 that link the proximal side of each spraying nozzle 20 [*4] to the corresponding circumferential location on the annular movable member 61B in an angularly displaceable manner. The spraying direction of each nozzle 20 [*4] is displaced simultaneously by the electromotive actuator 62B.

A jet mill provided with the above configuration is capable of variably adjusting the spraying direction of the plurality of nozzles 20, 21 simultaneously with one electromotive actuator 62A, 62B for each of the crushing chambers 12A, 12B. In this way, operations for determining optimal crushing conditions can be carried out simply and quickly while changing the spraying direction of each of the nozzles 20, 21.

The above configuration shortens the work of executing trials needed to set up the optimal conditions, and enables the processing time, electrical and other operational costs, waste of crushed material, and other conditions necessary for the execution of trials to be markedly reduced. The result is the ability to carry out high-efficiency pulverization with little waste of crushed material, even when there is only a small amount of the material to be crushed.

The electromotive actuators 62A, 62B may be disposed on each of the crushing chambers 12A, 12B instead of on each of the nozzles 20, 21, allowing overcrowding in the vicinity of the nozzles 20, 21 to be avoided, and making the assembly of the device simpler and maintenance easier. In addition, if necessary, each of the plurality of nozzles 20, 21 of the crushing chambers 12A, 12B can be made to swivel simultaneously. In this way, various crushing conditions corresponding to the type of crushed material or other such properties can be quickly and simply optimized, and Crushing can be carried out with good efficiency overall.

In the embodiment above, crushed material fed to the first crushing chamber 12A is subjected to a pulverization treatment by a high-speed swirl flow within the first crushing chamber 12A. Powder comminuted by this first pulverization procedure is discharged from the upper central area of the swirl flow and directed into the ventilation duct 15.

Some of the powder directed into the ventilation duct 15 ascends within the ventilation duct 15, passes through the gap of the straightening member 172, and is introduced into the second crushing chamber 12B. The powder is then subjected again to a crushing procedure (a second pulverization procedure) by a high-rate swirl flow in the second crushing chamber 12B.

Meanwhile, some of the powder conducted into the ventilation duct 15 momentarily ascends within the ventilation duct 15, but does not reach the second crushing chamber 12B and returns to the first crushing chamber 12A to be once again subjected to a pulverization procedure in the first crushing chamber 12A.

Here, powder of comparatively fine grain or completely comminuted powder has a high probability of reaching the interior of the second pulverization chamber 12B through buoyancy, while relatively coarse powder, inadequately comminuted powder, and large particles each have a high probability of returning to the interior of the first pulverization chamber 12A through gravity to be crushed again.

In other words, particle size is divided (graded) between the first pulverization chamber 12A and the second pulverization chamber 12B. The result is that only fine powder having a uniform particle size distribution will be ejected from the fine-powder discharge port 14B of the second pulverization chamber 12B.

In this way, the embodiment of the jet mill 10 described above is capable of achieving both good pulverization performance and good particle size distribution of the powder obtained via pulverization. Further, grading is carried out at the same time as pulverization, thereby alleviating or eliminating the necessity and procedural burden of post-treatment grading.

Additionally, contamination with coarse particles referred to as "spill" or "spillover" in the crushed material subjected to the crushing procedure can be prevented. Accordingly, obtaining comminuted material (fine powder) that has particle sizes below a set level or within a set range with high efficiency is possible without performing troublesome separation procedures using classifiers and the like.

The flow pathway diameter, length, and other properties of the ventilation duct 15 can be established with a greater degree of latitude in order to maintain the optimal grading conditions, settings, and other parameters. The straightening member 172 is extremely effective for greatly reducing the probability of coarse particles flying into the second pulverization chamber 12B, but grading conditions can also be established according to the associated shape; e.g., the width of the annular ventilation pathway formed in the space between the straightening member 172 and the fine powder introduction port 18.

In such instances, a configuration as described above, wherein the second pulverization chamber 12B is disposed concentrically above the first pulverization chamber 12A, and the first pulverization chamber 12A and the second pulverization chamber 12B are linked in the vertical direction via the ventilation duct 15, is especially suitable in order to satisfactorily carry out classification by size or grading.

Once the electromotive actuators 62A, 62B are in a regular operational state after optimized spraying directions for the nozzles 20, 21 have been established, regular operation within a specified swiveling stroke range may be performed. In this case, an improvement in crushing efficiency can be achieved by increasing the probability of collision and/or contact of the crushed material particles by implementing changes in the direction of the horizontal swirl flow within the crushing chambers 12A, 12B.

Synergistic results can be expected by using the second aspect in conjunction with the first aspect. Additionally, a variety of modes for the second aspect other than the formats described above are possible.

For example, the electromotive actuators 62A, 62B may be connected to the annular movable members 61A, 61B via specialized link arms separate from the link arms 64 provided to each of the nozzles 20, 21. Alternatively, the electromotive actuators 62A, 62B may be linked directly to the annular movable members 61A, 61B.

If oscillation drive units that cause the annular movable members 61A, 62B [*5] to oscillate at high speed are used for the electromotive actuators 62A, 62B, high-speed pulsing in the direction of the swirl flow is obtained, the probability of collision and/or contact of the crushed material particles can be increased, and crushing efficiency can thereby be improved.

In the embodiment described above, two first and second pulverization chambers 12A, 12B were linked together, but the present invention is also useful in a configuration in which a single crushing chamber is used or a configuration in which three or more pulverization chambers are linked.

A jet mill enabled to perform high-efficiency pulverization by optimizing various pulverization conditions according to the type of crushed material or other such properties can be provided according to the second aspect.

Third Aspect

A third aspect resolves the technical problems described below in addition to the solutions of the first aspect and second aspects.

Specifically, in a conventional jet mill 10', a plurality of spraying nozzles 20, 21 is disposed so that each spraying direction thereof faces in the same direction in the same horizontal plane in order to generate a high-rate horizontal swirl flow in a crushing chamber 12.

Crushed material introduced into the crushing chamber 12 is crushed and comminuted via a horizontal swirl flow generated by the nozzles 20, 21 disposed as described above, but the spraying rate of the gas needs to be fully increased in order to carry out efficient crushing. To increase the spraying rate of the gas, the operation gas pressure needs to be increased. To obtain this high-pressure actuating gas, large-scale compressor equipment that consumes large amounts of electricity is necessary.

According to the understanding of the present inventors, however, collisions between the crushed material particles carried by the swirl flow have been demonstrated to be a large factor in the crushing of material. Specifically, increasing the spraying rate of the gas fails to increase the probability of the material being crushed, if the crushed material is merely carried along by the resulting high-rate swirl flow. To carry out efficient crushing of the material, the probability of collisions occurring between the crushed material particles driven in high-rate swirls must be increased.

In the conventional jet mill 10' described above, however, the probability of occurrence of collisions that produce crushing is small due to crushed material particles introduced into the crushing chamber 12 being carried around in the high-rate horizontal swirl flow all together in the same direction at the same rate. Even when the gas is sprayed at a higher rate, crushing efficiency does not improve to a similar extent.

The third aspect solves technical problems such as those described above, and has a primary object as described hereunder.

Specifically, there is provided a jet mill enabled for carrying out high-efficiency pulverization by an increase in the probability of collisions between the crushed material particles driven by swirl flow.

The third aspect, which achieves the above object, will be described below based on the example shown in the drawings.

Figure 8:
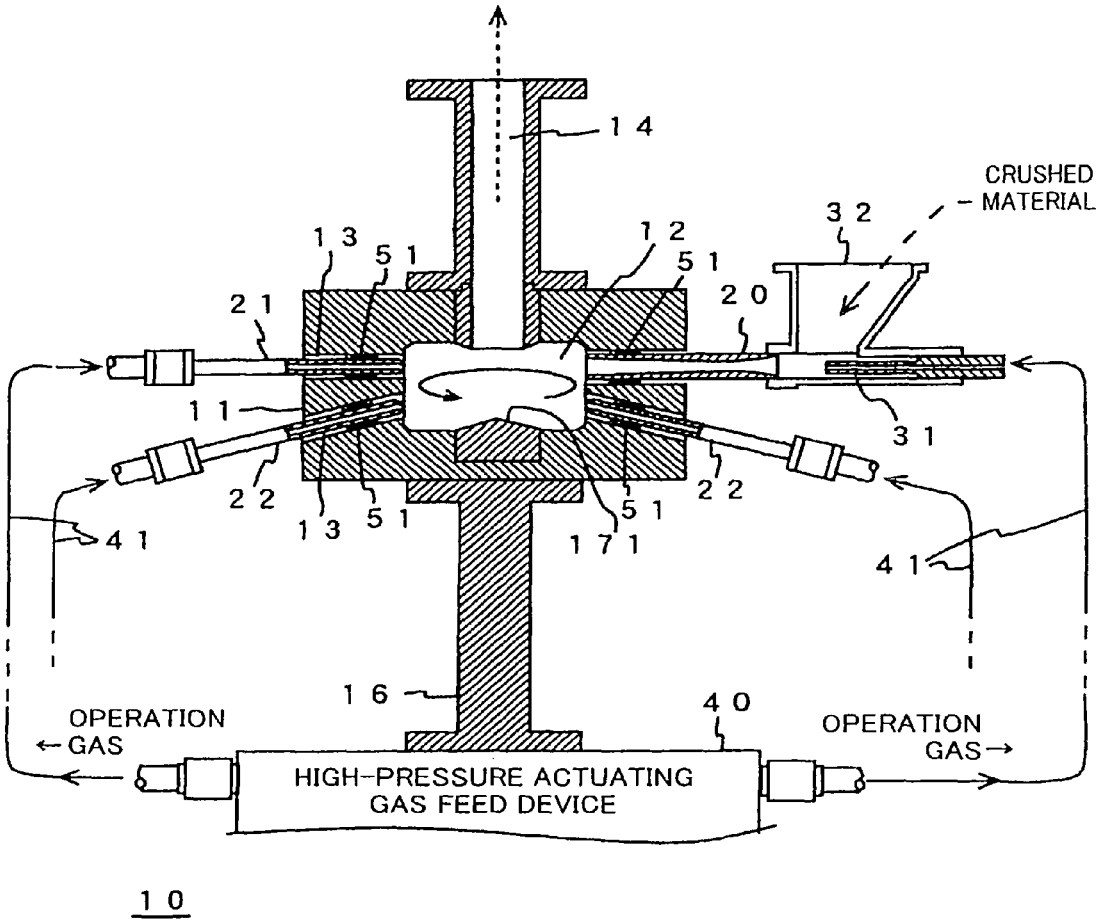
FIG. 8 is a partial schematic lateral sectional view showing an embodiment of a principal component of a jet mill according to a third aspect of the present invention.

FIG. 8 is a sectional view of a principal component of a jet mill constituting the third aspect of the present invention. A jet mill 10 shown in the drawing comminutes crushed material introduced into a horizontal disk-shaped crushing chamber 12 by a swirl flow generated by gas sprayed from a plurality of spraying nozzles 20 through 22 disposed in a ring along the internal perimeter wall of the crushing chamber 12.

The plurality of gas-jet nozzles 20 through 22 is provided in a housing 11 that describes the crushing chamber 12. The spraying nozzles 20 through 22 are divided into two types, first and second, according to the angle of placement thereof. First nozzles 20, 21 are formed as horizontal spraying nozzles 20, 21 disposed horizontally so as to generate a swirl flow in the horizontal direction within the crushing chamber 12. Second nozzles 22 are formed as oblique spraying nozzles 22 disposed obliquely so as to produce a vertical flow component in the swirl flow.

The horizontal spraying nozzles 20, 21 and the oblique spraying nozzles 22 are disposed so as to be stacked vertically. In other words, pairs are formed by the two types of horizontal spraying nozzles 20, 21 and oblique spraying nozzles 22. These nozzle pairs are disposed in a ring along the internal perimeter wall of the crushing chamber 12.

One nozzle (20) among the plurality of gas-jet nozzles 20 through 22 is formed as a solid-gas mixing ejector nozzle that feeds crushed material into the crushing chamber 12. This ejector nozzle (20) introduces and sprays crushed material fed from a hopper-shaped crushed material feed part 32 through a drive nozzle 31 along with a spray of a high-speed gas flow.

High-pressure gas (air or another suitable gas) is fed into each gas-jet nozzle 20 through 22 and the drive nozzle 31 via a gas feed tube 41 from a high-pressure actuating gas feed device 40.

Crushed material introduced into the crushing chamber 12 is drawn in, pulverized, and comminuted in the high-rate swirl flow generated by the gas sprayed from the plurality of gas-jet nozzles 20 through 22 disposed along the inner perimeter wall of the crushing chamber 12. The comminuted powder is ejected from a fine-powder discharge port 14 disposed above the central area of the crushing chamber 12.

A conical core part 171 is provided in the lower central area of the crushing chamber 12 for inducing a horizontal swirl flow. The housing 11 that describes the crushing chamber 12 is made into a suitably partitioned form (not shown). The housing 11 is stably disposed above a vertical support 16.

In the jet mill 10 described above, a vertical flow component is produced in the swirl flow by the oblique spraying nozzles 20, 21 [*6], and a swirl flow is generated in the horizontal direction in the crushing chamber 12 by the horizontal spraying nozzles 20, 21. In this way, the direction of movement of particulate crushed material introduced and rotatably driven in the crushing chamber 12 is varied, the probability of occurrence of crushing due to collisions of crushed material particles is thereby increased, and crushing efficiency can be greatly improved.

Additionally, in the jet mill 10 described above, nozzle pairs having horizontal spraying nozzles 20, 21 and an oblique spraying nozzle 22 oriented vertically are disposed in a ring along the inner perimeter wall of the crushing chamber 12. In this way, a two-layered swirl flow is formed wherein two gas flows are helically intertwined together while swirling, allowing for a further increase in the probability of collision and crushing of the crushed material particles.

The gas-jet nozzles 20, 21 [*7] are each inserted in a state allowing unrestricted movement in a radial direction in a through-hole 13 formed in the housing 11 of the pulverization chamber 12. In addition, the gas-jet nozzles 20, 21 [*7] are provided with a movable bearing 51 within the through-hole 13 that provides pivotal support in a directionally adjustable manner. In the resulting configuration, the direction into which the gas is sprayed into the pulverization chamber 12 is variably adjustable. A spherical bearing described earlier is used for the movable bearing 51.

Figure 9:
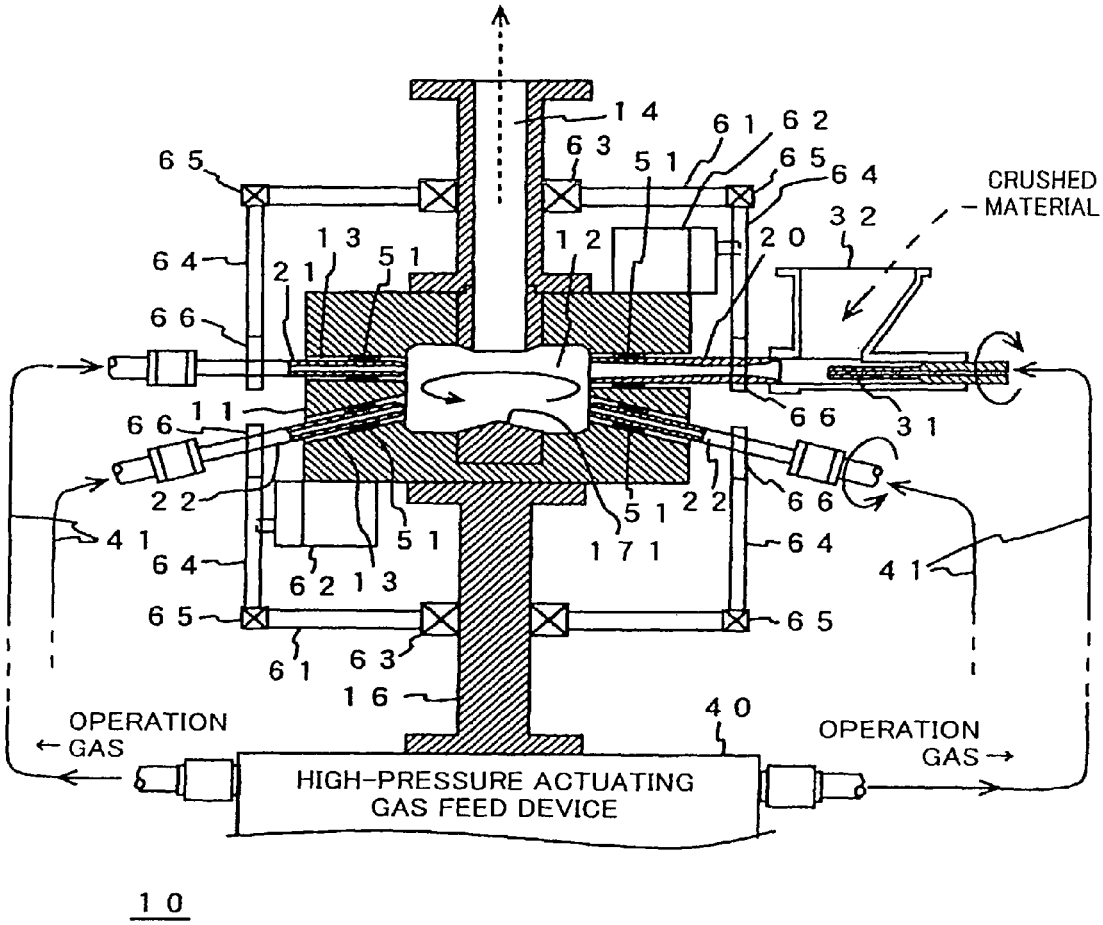
FIG. 9 is a schematic lateral sectional view showing a different embodiment relating to the principal component of a jet mill according to the third aspect.

FIG. 9 is a sectional view of a principal component showing an even more favorable embodiment of the third aspect. A jet mill 10 shown in the drawing is provided with movable bearings 51 that pivotally support the mobility of the plurality of spraying nozzles 20 through 22 in the gas-spraying direction, annular movable members 61 that are disposed above and [*8] below the line of nozzles (20 through 22) and are movably supported so as to be able to swivel in the direction orthogonal to the axial direction of the nozzles 20 through 22, electromotive actuators 62 that swivelably drive the annular movable members 61, and link arms 64 that link the proximal side of each spraying nozzle 20 through 22 to the corresponding circumferential location on the annular movable members 61 in an angularly displaceable manner. The jet mill is configured so that the spraying direction of each nozzle 20 through 22 is displaced simultaneously by the electromotive actuators 62.

In this case, the nozzles 20 through 22 are divided into an upper-side group of horizontal spraying nozzles 20, 21 and a lower-side group of oblique spraying nozzles 22, and are swivelably driven. Specifically, the upper-side horizontal spraying nozzles 20, 21 are swivelably driven in a circular loop by the annular movable member 61, the electromotive actuator 62, and the link arms 64 disposed on the upper side of the housing 11. The lower-side oblique spraying nozzles 22 are swivelably driven in a circular loop by the annular movable member 61, the electromotive actuator 62, and the link arms 64 disposed on the upper [*9] side of the housing 11.

The linking provided by the link arms 64 is accomplished by directionally displaceable linkage parts (free joints) 65, 66. In this way, each nozzle 21, 20 [*10] is linked to the other nozzles 21, 20 [*10] by common connection to the annular movable member 61 via the link arm 64 of each nozzle. The annular movable members 61 are disc-shaped with a centrally disposed through-hole, and are pivotally supported to be able to swivel via annular free bearings 63 on the support 16 or a discharge tube.

An electric motor provided with a rotational deceleration mechanism and a mechanism that converts to a rotational or other such mode is used as the drive source unit for the electromotive actuators 62. The drive operation of the electromotive actuators 62 is controlled by a control part 71. The control part 71 is provided with positional control functionality for stopping the annular movable member 61 in an arbitrary positional displacement. To exert this control, the electromotive actuators 62 are provided with positional detection functionality.

In this embodiment, the electromotive actuators 62 are linked to one of the link arms 64, and swivelably drive the annular movable members 61 via the linked link arm 64. The annular movable members 61 are configured so as to transmit the same stroke movement to each of the link arms 64. In this way, each of the nozzles 20, 21 [*7] is swivelably driven at the same time and with the same displacement stroke via the electromotive actuator 62.

Further, the swiveling drive of the electromotive actuator 62 may, if necessary, have operational modes other than a circular loop, such as linear reciprocating motion.

In the embodiment shown in FIG. 9, the plurality of nozzles 20 through 22 are divided and swivelably driven as an upper-side group of horizontal spraying nozzles 20, 21 and a lower-side group of oblique spraying nozzles 22, as described above. In such instances, an even greater variety of high-rate swirl flow modes can be established by separately selecting the swiveling drive direction of the upper-side horizontal spraying nozzles 20, 21 and the swiveling drive direction of the lower-side oblique spraying nozzles 22.

Specifically, when the group of spraying nozzles 20, 21 are made to rotate in a clockwise direction, a high-rate swirl flow with an even higher probability of collision and/or contact among the crushed material particles within the crushing chamber 12 can be achieved by causing the other group of spraying nozzles 22 to rotate in the opposite, counter-clockwise direction, as shown by the arrows in FIG. 9. Further large improvements in crushing efficiency can thereby be achieved.

In the example shown in FIG. 9, the rotational directions of the nozzles are established through division into a group of upper-side horizontal nozzles 20, 21 and a group of lower-side oblique nozzles 22, but similar effects can be expected from implementing variations among the upper-side horizontal spraying nozzles 20, 21 or among the lower-side oblique spraying nozzles 22. In this case, the link combination of the link mechanism that performs the swiveling drive may be changed.

Figure 10:
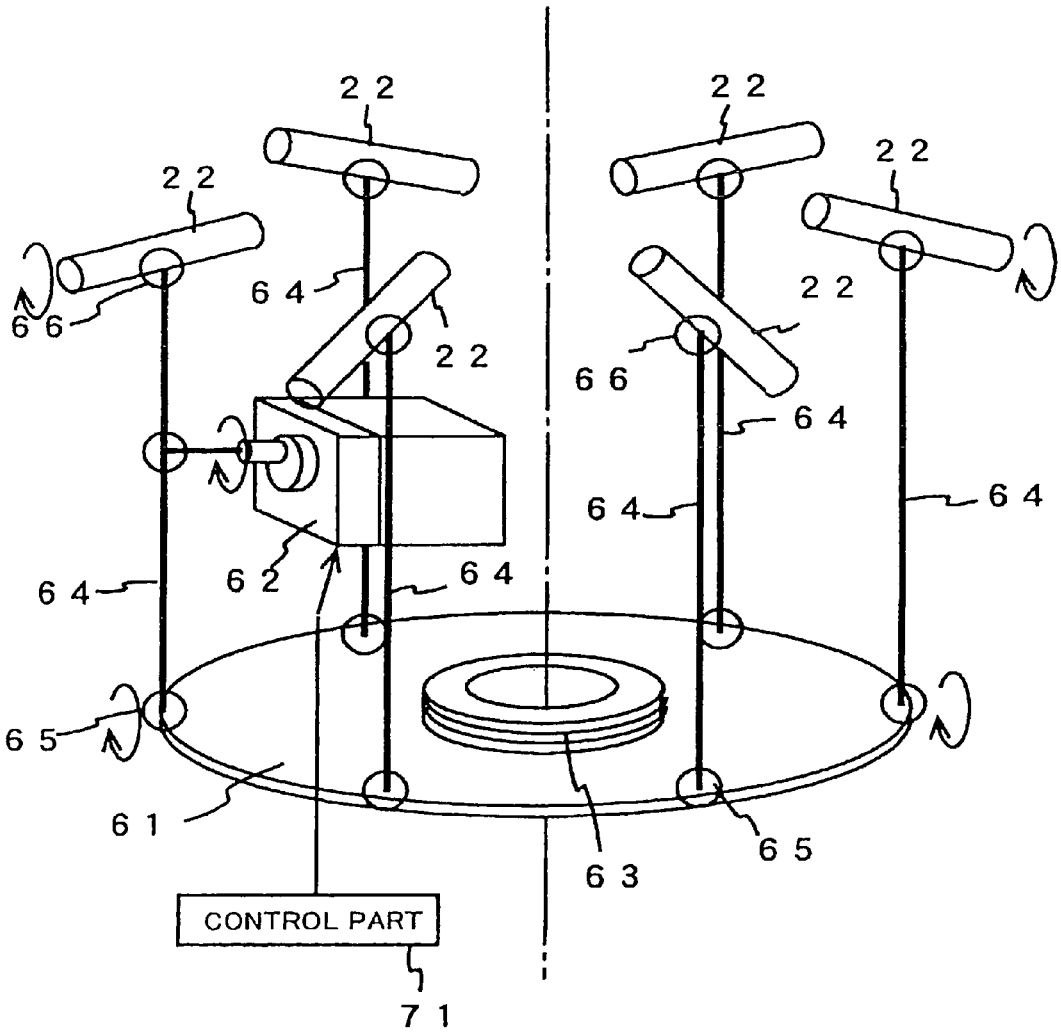
FIG. 10 schematically shows a mechanical component for variably driving the spraying direction of the nozzles according to the third aspect.

FIG. 10 schematically shows a mechanical component for variably driving the spraying direction of the plurality of nozzles 22. As shown in the drawing, the direction of each nozzle 22 is variably driven simultaneously in a mutually linked state by the annular movable member 61, the electromotive actuator 62, and the link arms 64. Although it is not shown in the drawing, the direction of the nozzles 20, 21, as well, is variably driven in the same way, i.e., simultaneously in a mutually linked state by the annular movable member 61, the electromotive actuator 62, and the link arms 64.

Since a jet mill provided with the above-described nozzle drive mechanism is capable of variably adjusting the spraying direction of a plurality of nozzles 22 (or 20, 21) in a simultaneous manner with the aid of one electromotive actuator 62, operations for determining spraying angles for obtaining optimal crushing conditions can be carried out simply and quickly while the spraying direction of each nozzle 22 (or 20, 21) is changed.

The work of executing trials needed to set up the optimal conditions is thereby shortened, and the processing time, electrical and other operational costs, waste of crushed material, and other conditions necessary for the execution of trials are markedly reduced. The result is the ability to carry out high-efficiency pulverization with little waste of crushed material, even when there is only a small amount of the material to be crushed.

One electromotive actuator 62 may be placed in position for the plurality of nozzles 22 (or 20, 21) instead of one electromotive actuator 62 for each of the nozzles 20, 21 individually, allowing overcrowding in the vicinity of the nozzles 20 through 22 to be avoided and making the assembly of the device simpler and maintenance easier. Further, if necessary, both the horizontal and oblique nozzles 20 through 22 may be made to swivel simultaneously.

The third aspect may have a variety of modes other than the formats described above. For example, the oblique spraying nozzles 22 may be disposed above the horizontal spraying nozzles 20, 21. The ejector nozzles may also be configured as oblique spraying nozzles, or as both horizontal and oblique spraying nozzles.

Additionally, if necessary, various oblique spraying nozzles 22 may be disposed above and below the horizontal spraying nozzles 20, 21. In other words, different combinations may be used for the vertical positional relationship of the oblique spraying nozzles 22 and the horizontal spraying nozzles 20, 21. Further, a three-dimensional swirl flow may be produced by two types of oblique spraying nozzles inclined upward and downward.

As in the first or second aspects, an oscillation drive unit such as an ultrasonic wave oscillator or the like may be used for the electromotive actuator. In this case, an effect may be expected wherein the probability of collisions occurring among the crushed material particles increases due to the pulsing of the gas sprayed from the nozzles.

Fourth Aspect

A fourth aspect is provided with the characteristics of the second aspect as well as the third aspect, and resolves the technical problems described hereunder in addition to the solutions of the first through third aspects.

Figure 16A:
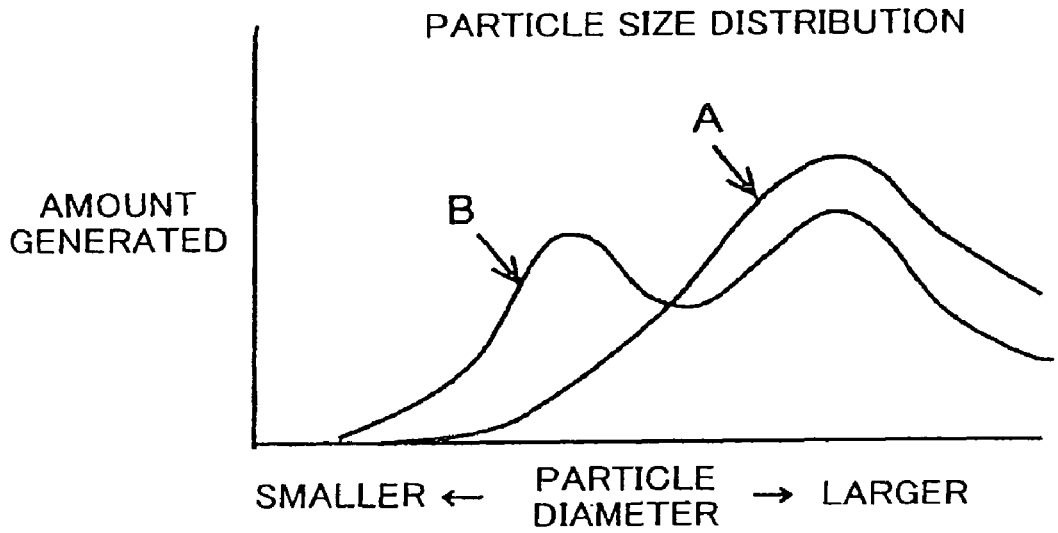
FIG. 16 is a graph showing examples of a particle size distribution obtained from a conventional jet mill (a), and a particle size distribution obtained from a jet mill of the present invention (b)

Specifically, in a conventional jet mill 10', the occurrence of problems has been demonstrated wherein the particle size distribution of the pulverized and comminuted powder becomes inconsistent (uneven) when attempts are made to increase the pulverization performance. Specifically, as shown in FIG. 16A, when an attempt is made to increase crushing performance by raising the spraying pressure, the particle size distribution of the powder changes from the single state of curve A to the split state of curve B, demonstrating that two types of powder with dramatically different particle sizes (comminuted particles and coarse particles) inevitably become combined.

For example, with ceramic powders, or pesticides, toners, or the like, the powder particle size is preferably as uniform as possible, but in conventional jet mills as described above, good pulverization performance and good particle size distribution are difficult to achieve with the powder obtained via pulverization, and problems are presented insofar as the particle size distribution becomes uneven when an attempt is made to increase pulverization performance.

Thus, grading wherein only powder having the desired particle size range is sorted from the powder pulverized in the jet mill is an indispensable post-treatment in the pulverization step performed with conventional jet mills.

The fourth aspect solves technical problems such as those described above, and a primary object thereof is as described below.

Specifically, there is provided a jet mill suited to achieve good pulverization performance and good particle size distribution of the powder obtained via pulverization.

There is also provided a jet mill capable of alleviating or removing the necessity and procedural burden of post-treatment grading by performing grading at the same time as pulverization.

There is additionally provided a jet mill capable of alleviating the burden of peripheral equipment such as compressors and the like while still achieving high pulverization performance.

There is further provided a jet mill capable of performing high-efficiency pulverization by optimizing various pulverization conditions according to the type of crushed material or other such properties.

The fourth aspect, which achieves the above objects, will be described below based on the example shown in the drawings.

Figure 11:
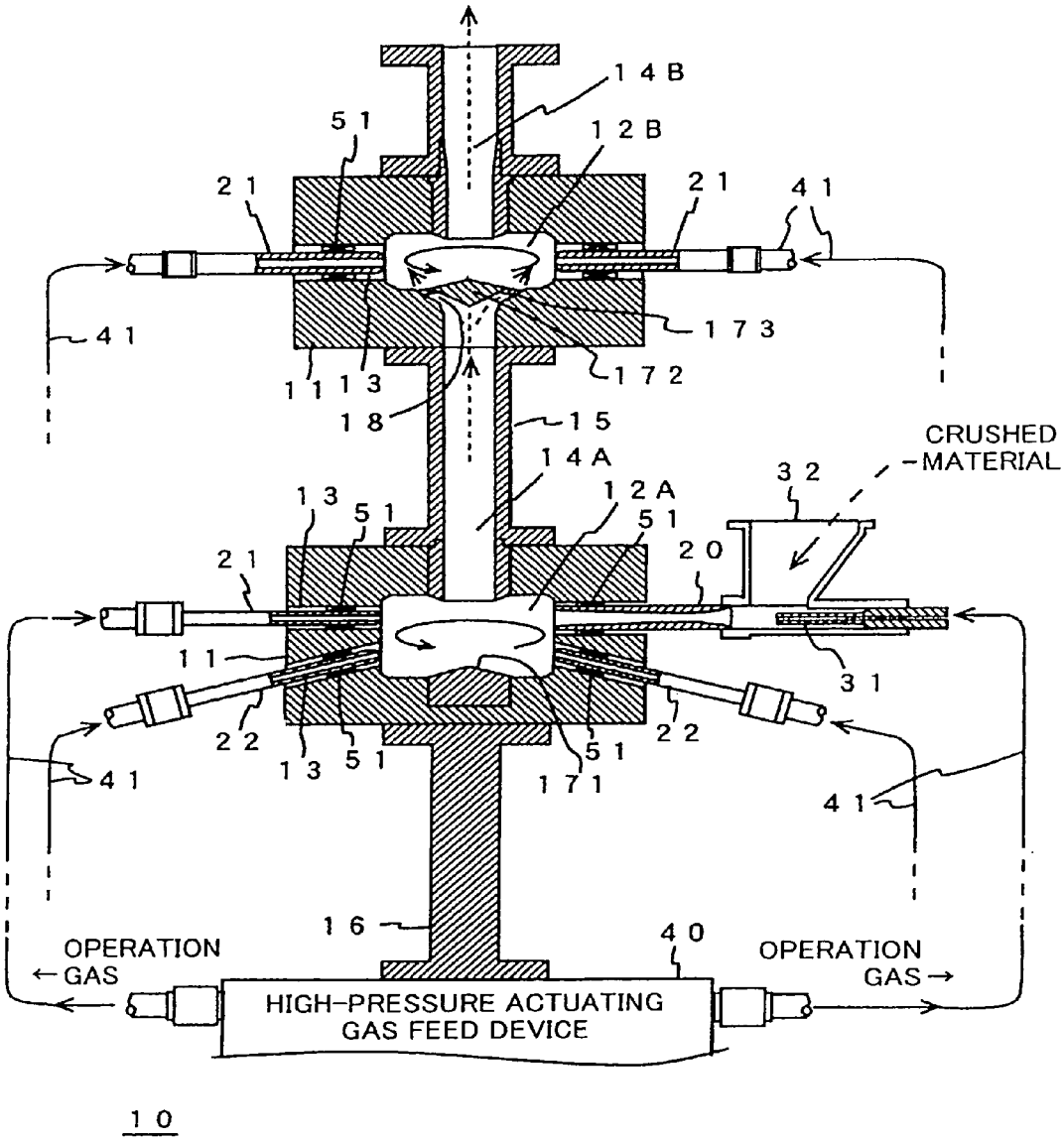
FIG. 11 is a partial schematic lateral sectional view showing an embodiment of a principal component of a jet mill according to a fourth aspect of the present invention.

FIG. 11 is a sectional view of a primary component of a jet mill 10 made according to the fourth aspect of the present invention. A jet mill 10 shown in the drawing has two first and second crushing chambers 12A, 12B, as in the second aspect, the two crushing chambers 12A, 12B perform comminuting via the swirl flow, and fine-powder discharge ports 14A, 14B are provided in the upper central areas of the crushing chambers 12A, 12B. The first crushing chamber 12A is provided with a solid-gas mixing ejector nozzle 20 for feeding crushed material from the exterior, and the second crushing chamber 12B has a fine powder introduction port formed in a lower central area of the crushing chamber 12B. The fine-powder discharge port 14 [*11] of the first crushing chamber 12A and the fine powder introduction port 18 of the second crushing chamber 12B are communicatingly connected by a ventilation duct 15.

The second crushing chamber 12B is disposed concentrically above the first crushing chamber 12A, and the first crushing chamber 12A and the second crushing chamber 12B are linked in the vertical direction via the ventilation duct 15. A housing 11 of the first pulverization chamber 12A is disposed above a vertical support 16, and a housing 11 of the second pulverization chamber 12B is disposed above the ventilation duct 15.

A straightening member 172 that inhibits reverse flow of fine powder is disposed between the fine-powder discharge port 14A of the first crushing chamber 12A and the fine powder introduction port 18 of the second crushing chamber 12B. The straightening member 172 is a flattened-cone member and, in the embodiment in the drawing, is disposed so as to selectively plug the central area of the fine powder introduction port 18.

In the embodiment above, crushed material fed to the first crushing chamber 12A is subjected to a pulverization treatment by a high-speed swirl flow within the first crushing chamber 12A. Powder comminuted by this first pulverization procedure is discharged from the upper central area of the swirl flow and conducted into the ventilation duct 15.

Some of the powder directed into the ventilation duct 15 ascends within the ventilation duct 15, passes through the gap of the straightening member 172, and is introduced into the second crushing chamber 12B. The powder is then subjected again to a crushing procedure (a second pulverization procedure) by a high-rate swirl flow in the second crushing chamber 12B.

Meanwhile, some of the powder conducted into the ventilation duct 15 momentarily ascends within the ventilation duct 15, but does not reach the second crushing chamber 12B and returns to the first crushing chamber 12A to be once again subjected to a pulverization procedure in the first crushing chamber 12A.

Here, powder of comparatively fine grain or completely comminuted powder has a high probability of reaching the interior of the second pulverization chamber 12B through buoyancy, while relatively coarse powder, inadequately comminuted powder, and large particles each have a high probability of returning to the interior of the first pulverization chamber 12A through gravity to be crushed again.

Figure 16B:
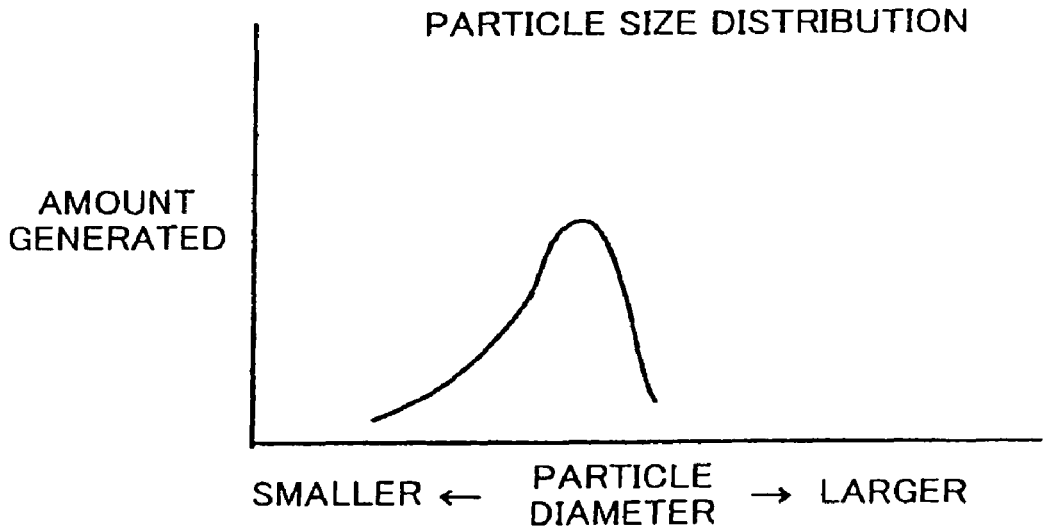
Figure 17:
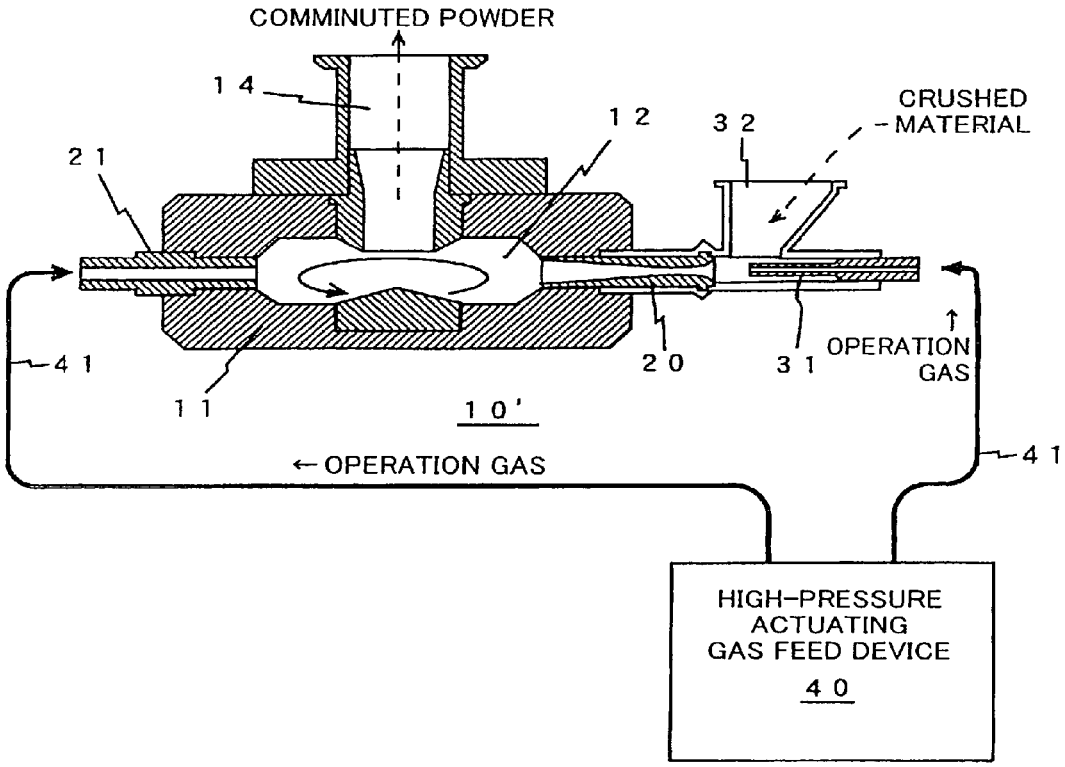
FIG. 17 is a lateral sectional view that schematically shows the principal component of a conventional jet mill.
Figure 18:
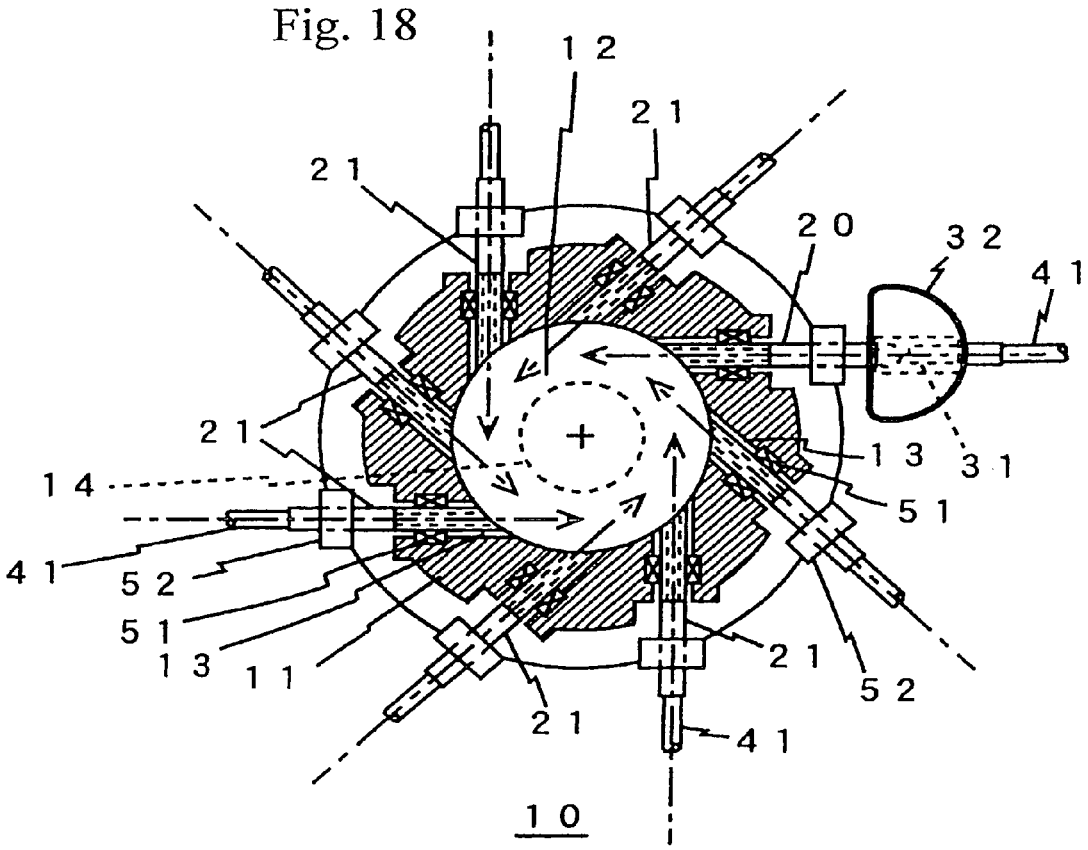
FIG. 18 is a cross-sectional view that schematically shows the principal component of a conventional jet mill.

In other words, particle size is divided (graded) between the first pulverization chamber 12A and the second pulverization chamber 12B. The result is that only fine powder having a uniform particle size distribution as shown in FIG. 16B will be ejected from the fine-powder discharge port 14B of the second pulverization chamber 12B.

In this way, the embodiment of the jet mill 10 described above is capable of achieving good pulverization performance and good particle size distribution of the powder obtained via pulverization. Additionally, grading is carried out at the same time as pulverization, alleviating or removing the necessity and procedural burden of post-treatment grading.

Additionally, contamination with coarse particles referred to as "spill" or "spillover" in the crushed material subjected to the crushing procedure can be prevented. Accordingly, obtaining comminuted material (fine powder) that has particle sizes below a set level or within a set range with high efficiency is possible without performing troublesome separation procedures using classifiers and the like.

The flow pathway diameter, length, and other properties of the ventilation duct 15 can be established with a greater degree of latitude in order to maintain the optimal grading conditions, settings, and other parameters. The straightening member 172 is extremely effective for greatly reducing the probability of coarse particles flying into the second pulverization chamber 12B, but grading conditions can also be established according to the associated shape; e.g., the width of the annular ventilation pathway formed in the space between the straightening member 172 and the fine powder introduction port 18.

In such instances, a configuration as described above, wherein the second pulverization chamber 12B is disposed concentrically above the first pulverization chamber 12A, and the first pulverization chamber 12A and the second pulverization chamber 12B are linked in the vertical direction via the ventilation duct 15, is especially suitable in order to satisfactorily carry out classification by size or grading.

Figure 12:
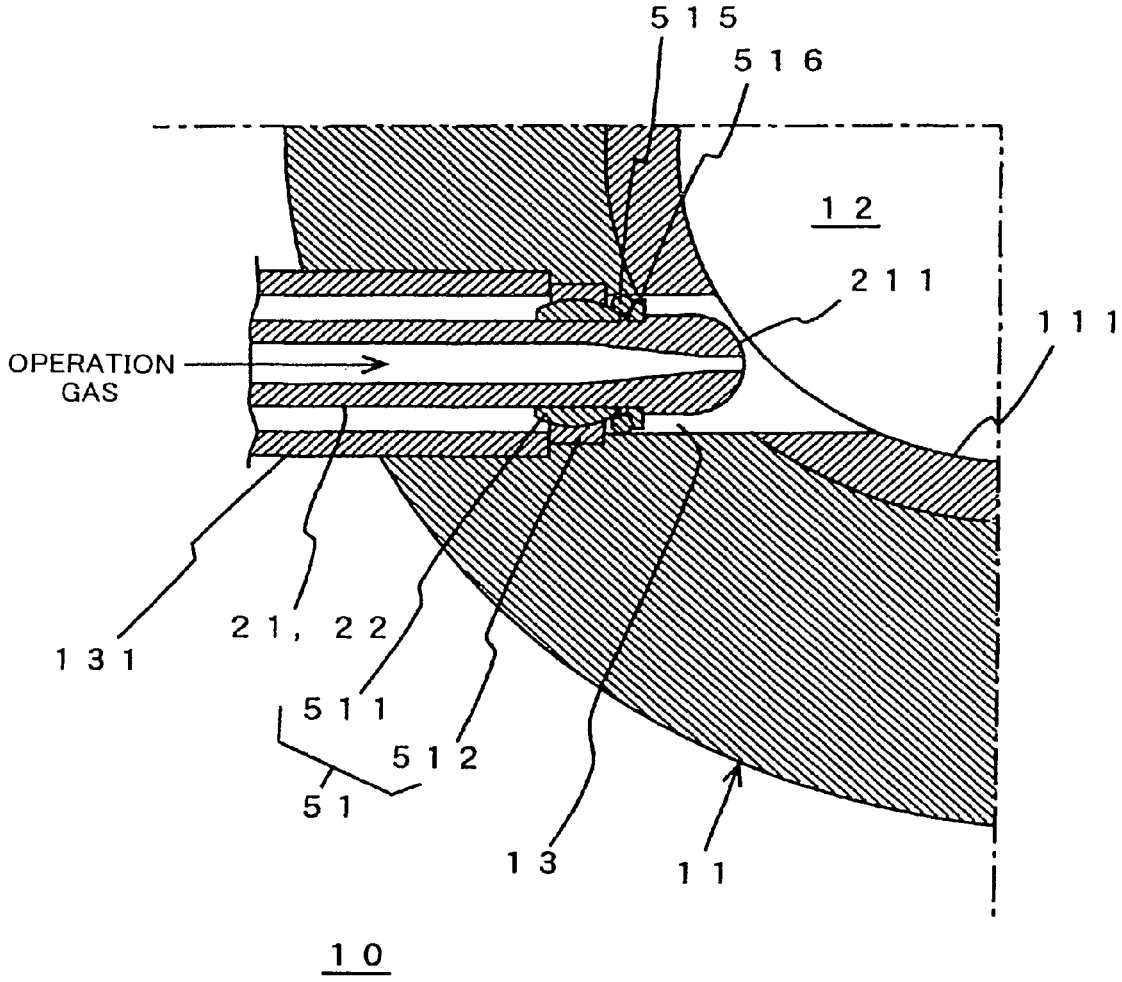
FIG. 12 is a sectional view showing a preferred embodiment of the distal part of a nozzle according to the fourth aspect.

FIG. 12 shows a preferred embodiment of the distal part of a nozzle 21, 22. If the spraying direction of the nozzles 21, 22 is variable, a distal surface 211 of the nozzles 21, 22 may be formed into a spherical shape (or a bullet-shell shape) as shown in the drawing. Additionally, as shown in the drawing, the distal part of the nozzles 21, 22 may be formed so as to be slightly recessed from the surface of the inner perimeter wall of the pulverization chamber 12. This configuration of the nozzles 21, 22 can be advantageously applied to the first and second aspects [*12].

In addition to being inserted in a state allowing unrestricted movement in a radial direction in a through-hole 13 formed in the housing 11 of the crushing chamber 12, the nozzles 21, 22 are pivotally supported in variable directionality by a movable bearing 51 that is inserted between the through-hole 13 and the nozzle 21, 22.

The movable bearing 51 is configured using an annular mobile slider 511 with a spherical outer circumferential surface, and an annular fixed slider 512 having a spherical inner circumferential surface that is fit onto the outer circumferential surface of the mobile slider 511. The mobile slider 511 is mounted on the outer circumference of the spraying nozzles 20, 21 [*10]. The fixed slider 512 is mounted on the inner side of the through-hole 13.

Additionally, in the drawing, 515 denotes a sealing O-ring, and 516 denotes an annular locking part that confines the O-ring 515 in a fixed position. Additionally, 131 is a mantle tube. The nozzles 21, 22 are pivotally supported in variable directionality on the inner side of the mantle tube 131 [*13]. The drawing shows the movable pivotal support structure of the nozzles 21, 22, but the ejector nozzle 20 is also movably supported to pivot in the same way.

Figure 13:
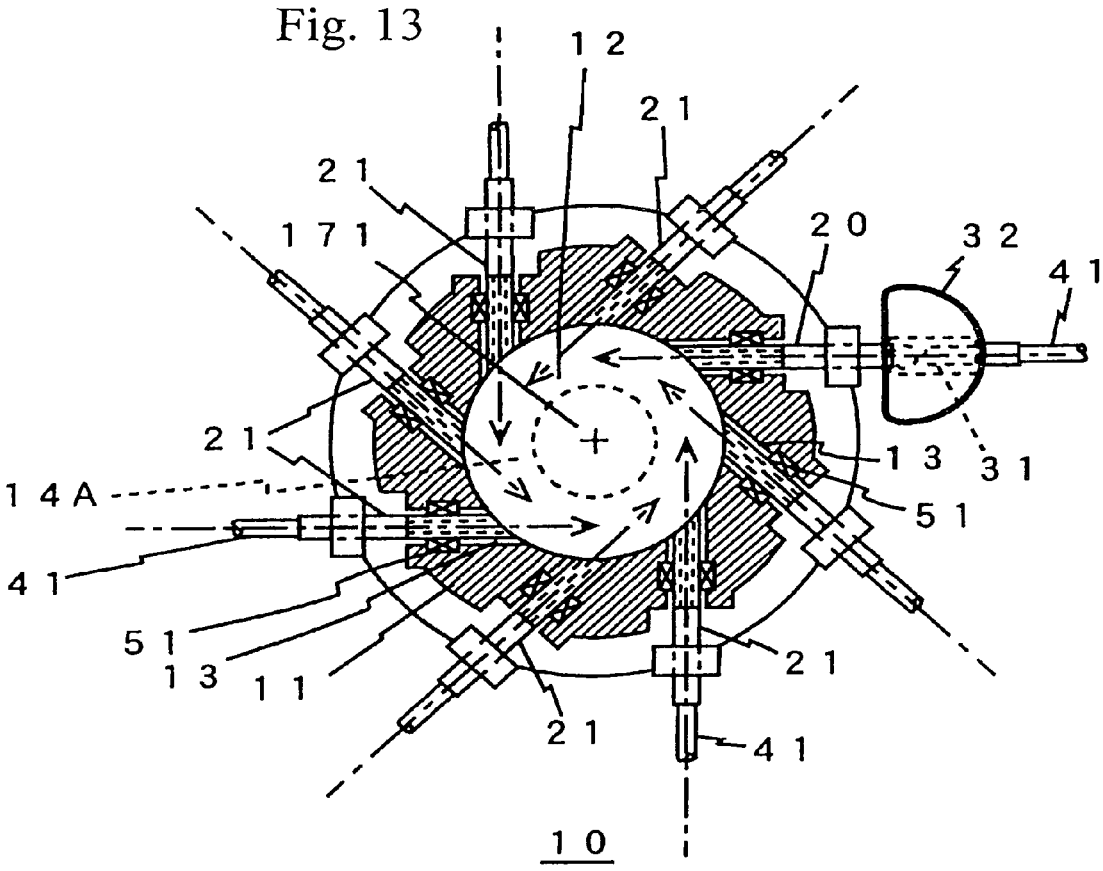
FIG. 13 is a cross-sectional view showing a horizontal cut-away from above the horizontal spraying nozzles of a crushing chamber according to the fourth aspect.
Figure 14:
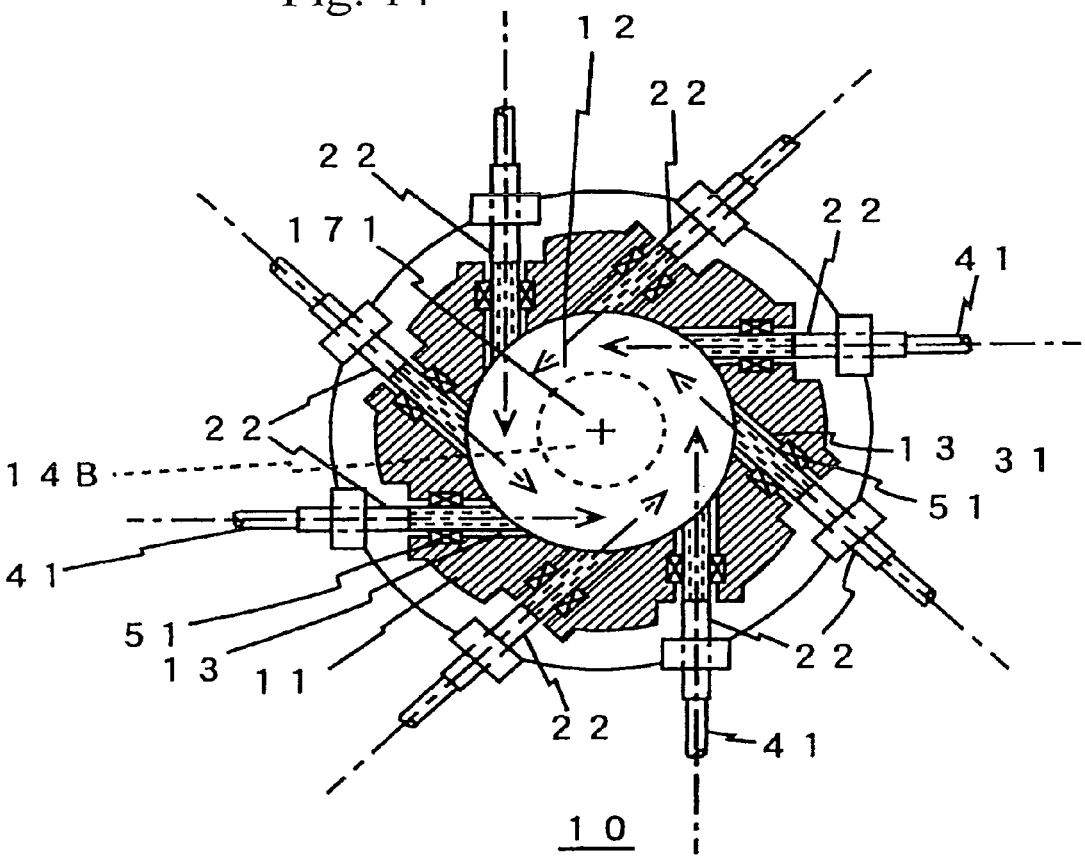
FIG. 14 is a cross-sectional view showing a horizontal cut-away from above the oblique spraying nozzles of a crushing chamber according to the fourth aspect.

FIG. 13 shows a horizontal cut-away cross-sectional view from above the horizontal spraying nozzles 20, 21 of the crushing chamber 12 of FIG. 8 or FIG. 9. FIG. 14 shows a horizontal cut-away cross-sectional view from above the oblique spraying nozzles 22 of the crushing chamber 12. As shown in the drawings, a plurality of horizontal spraying nozzles 20, 21 and oblique spraying nozzles 22 is installed in the housing 11 that forms the crushing chamber 12.

Each spraying nozzle 20 through 22 is disposed so that the spray orifice thereof faces a prescribed direction [*14] within the crushing chamber 12. Additionally, the horizontal spraying nozzles 20, 21 and the oblique spraying nozzles 22 are disposed so as to be stacked vertically, with pairs of horizontal and oblique nozzles disposed in a ring along the internal perimeter wall of the crushing chamber 12.

With nozzles disposed as described above, an even more effective swirl flow can be generated in directions within three dimensions to increase the probability of crushing caused by collisions between the crushed material particles.

Figure 15:
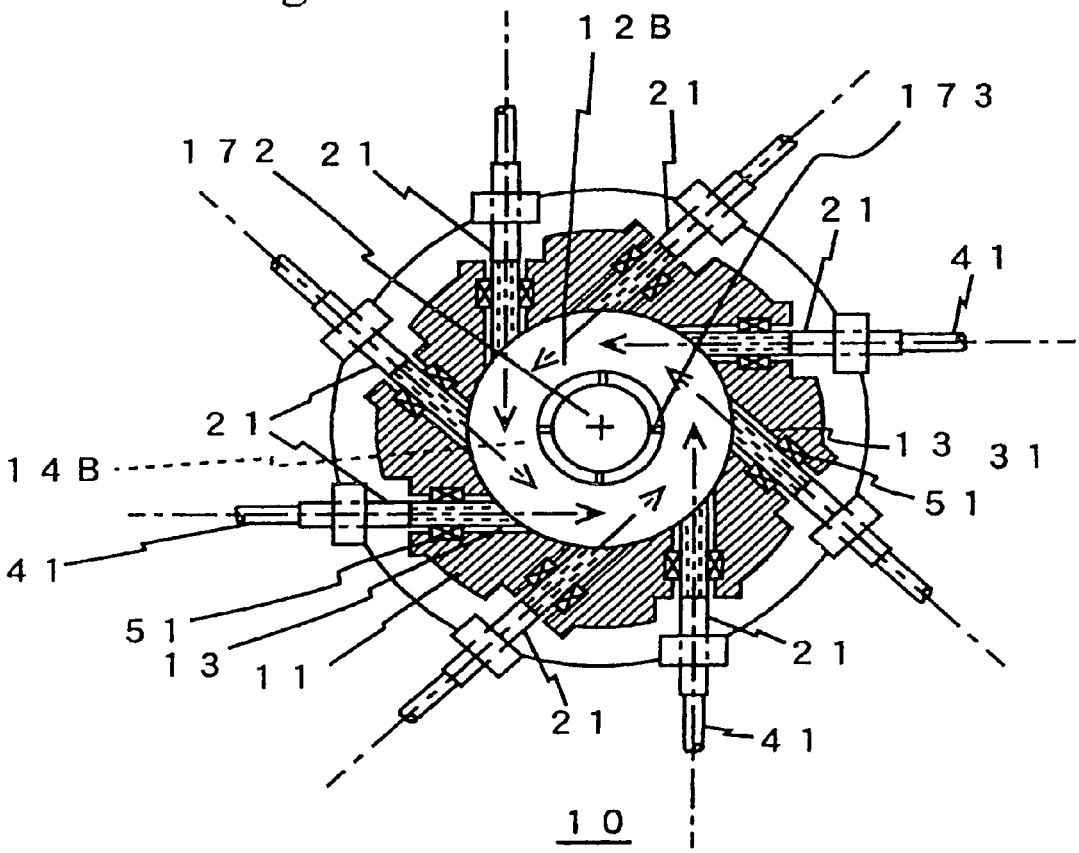
FIG. 15 is a cross-sectional view showing a horizontal cut-away of a second crushing chamber 12B according to the fourth aspect.

FIG. 15 shows a horizontal cut-away cross-sectional view of the second crushing chamber 12B shown in FIG. 11. As shown in the drawings, a straightening member 172 that inhibits reverse flow of fine powder is disposed between the fine-powder discharge port 14A of the first crushing chamber 12A and the fine powder introduction port 18 of the second crushing chamber 12B. The straightening member 172 is a flattened-cone member and is disposed so as to selectively plug the central area of the fine powder introduction port 18. The straightening member 172 is fixed in a prescribed position by a stay part 173. An annular ventilation channel is formed between the straightening member 172 and the fine powder introduction port 18.

A variety of modes may be used for the fourth aspect other than the formats described above. For example, the oblique spraying nozzles 22 may be disposed above the horizontal spraying nozzles 20, 21. The ejector nozzles may also be configured as oblique spraying nozzles, or as both horizontal and oblique spraying nozzles.

Additionally, if necessary, various oblique spraying nozzles 22 may be disposed above and below the horizontal spraying nozzles 20, 21. Further, swirl flow in directions within three dimensions may be produced by two types of oblique spraying nozzles inclined upwardly and downwardly.

As in the first or second aspects [*12], an oscillation drive unit such as an ultrasonic wave oscillator or the like may be used for the electromotive actuator. In this case, an effect may be expected wherein the probability of the crushed material particles colliding increases due to the pulsing of the gas sprayed from the nozzles.

The ventilation duct 15 is a straight tube, but depending on the pulverization conditions, a helical ventilation duct 15, for example, may also be effective. Similarly, the first pulverization chamber 12A and the second pulverization chamber 12B may assume a positional relationship other than a vertical orientation; e.g., a diagonal or horizontal relationship.

In the embodiment described above, two first and second pulverization chambers 12A, 12B are linked together, but the present invention is also effective with configurations in which three or more pulverization chambers are linked together.

According to the fourth aspect, high-efficiency pulverization can be performed by increasing the probability of collision between crushed material particles driven by a swirl flow in a jet mill in which crushed material introduced into a horizontal disk-shaped crushing chamber is comminuted by a swirl flow generated by gas sprayed from a plurality of spraying nozzles disposed in a ring along the internal perimeter wall of the crushing chamber.

Additionally, a jet mill enabled to achieve good pulverization performance and good particle size distribution of the powder obtained via pulverization can be provided.

A jet mill capable of alleviating or removing the necessity and procedural burden of post-treatment grading by performing grading at the same time as pulverization can be provided.

A jet mill capable of alleviating the burden of peripheral equipment such as compressors and the like while still achieving high pulverization performance can be provided.

A jet mill capable of performing high-efficiency pulverization by optimizing various pulverization conditions according to the type of crushed material or other such properties can be provided.

The effects described above can be achieved by the second aspect [*15], but the fourth aspect not only contributes the effects obtained with the second aspect, but also provides the effect of enabling dramatic improvements in the pulverization efficiency as well as the probability of collision between the crushed material particles driven by the swirl flow.

INDUSTRIAL APPLICABILITY

According to the present invention, a jet mill enabled to perform high-efficiency pulverization by optimizing various pulverization conditions according to the type of crushed material or other such properties can be provided.

Specifically, a jet mill enabled for performing high-efficiency pulverization by increasing the probability of collision between crushed material particles driven by a swirl flow can be provided.

Additionally, a jet mill enabled to achieve good pulverization performance and good particle size distribution of the powder obtained via pulverization can be provided.

Further, a jet mill capable of alleviating or removing the necessity and procedural burden of post-treatment grading by performing grading at the same time as pulverization can be provided.

A jet mill capable of alleviating the burden of peripheral equipment such as compressors and the like while still achieving high pulverization performance can be provided.

A jet mill capable of performing high-efficiency pulverization by optimizing various pulverization conditions according to the type of crushed material or other such properties can be provided. [*1]

KEY

10 Jet mill
11 Housing
12 Crushing chamber
12A First crushing chamber
12B Second crushing chamber
13 Through-hole
14 Fine-powder discharge port
14A First fine-powder discharge port
14B Second fine-powder discharge port
15 Ventilation duct
16 Vertical support
171 Conical core part
172 Straightening member
173 Stay part
18 Fine powder introduction port
20 Gas-jet nozzle (ejector nozzle)
21 Gas-jet nozzle (horizontal spraying nozzle)

22 Vertical [*16] spraying nozzle
31 Drive nozzle
32 Crushed material feed part
40 High-pressure actuating gas feed device
41 Gas feed tube
51 Movable bearing (spherical bearing)
511 Mobile slider
512 Fixed slider
513 Channel
514 Feeder
52 Variable holding means
531 Boss member
532 Central through-hole
533 Movable member
534 U-shaped notch part
535 Fixing screw (stop screw)
61 Annular movable member
61A, 61B Annular movable members
62 Drive actuator
62A, 62B Drive actuators
63 Free bearing
64 Link arm
65, 66 Linkage part (free joint)
65, 66 Linkage part (free joint) [*17]
71 Control part

What is claimed is:

1. A jet mill in which material introduced into a crushing chamber is comminuted by a swirl flow produced by gas sprayed from a plurality of spraying nozzles disposed along an internal perimeter wall of the crushing chamber, said jet mill comprising:

a plurality of spraying nozzles;

a movable bearing for pivotally supporting the plurality of spraying nozzles so as to allow movement of the direction in which gas is sprayed from each;

an annular movable member that is disposed above or below a row of the nozzles, and is movably supported to swivel in a direction orthogonal to an axial direction of the nozzles;

an electromotive actuator for swivelably driving the annular movable member; and a link arm for linking a distal side of each spraying nozzle to a corresponding circumferential position on the annular movable member in an angularly displaceable manner, wherein the spraying direction of each nozzle is displaced simultaneously by the electromotive actuator.

2. The jet mill of claim 1, wherein the electromotive actuator is linked to one of the link arms linked to the annular movable member, and swivelably drives the annular movable member via the linked link arm.

3. The jet mill of claim 1, wherein an electric motor provided with a rotational deceleration mechanism is used as a drive source unit for the electromotive actuator; and a controller is provided that stops the annular movable member in an arbitrary positional displacement.

4. The jet mill of claim 1, wherein an oscillation drive unit for driving high rate oscillation of the annular movable member is used as the electromotive actuator.

5. The jet mill of claim 2, wherein an electric motor provided with a rotational deceleration mechanism is used as a drive source unit for the electromotive actuator; and a controller is provided that stops the annular movable member in an arbitrary positional displacement.

6. The jet mill of claim 2, wherein an oscillation drive unit for driving high-rate oscillation of the annular movable member is used as the electromotive actuator.

* * * * *